US010160215B2

(12) United States Patent
Kobayashi et al.

(10) Patent No.: US 10,160,215 B2
(45) Date of Patent: Dec. 25, 2018

(54) FLOW CHANNEL MEMBER, LIQUID DISCHARGE HEAD, AND RECORDING DEVICE

(71) Applicant: KYOCERA Corporation, Kyoto-shi, Kyoto (JP)

(72) Inventors: Naoki Kobayashi, Kirishima (JP); Hiroyuki Kawamura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/320,906

(22) PCT Filed: Jun. 25, 2015

(86) PCT No.: PCT/JP2015/068365

§ 371 (c)(1),
(2) Date: Dec. 21, 2016

(87) PCT Pub. No.: WO2015/199181

PCT Pub. Date: Dec. 30, 2015

(65) Prior Publication Data

US 2017/0151792 A1 Jun. 1, 2017

(30) Foreign Application Priority Data

Jun. 27, 2014 (JP) ..... 2014-132796

(51) Int. Cl.
*B41J 2/175* (2006.01)
*B41J 2/14* (2006.01)
(Continued)

(52) U.S. Cl.
CPC ..... *B41J 2/175* (2013.01); *B41J 2/14209* (2013.01); *B41J 2/2146* (2013.01); *B41J 29/02* (2013.01);
(Continued)

(58) Field of Classification Search
CPC .... B41J 2002/14419; B41J 2002/14459; B41J 2/175; B41J 2002/14306; B41J 2/17513; B41J 2/17503
(Continued)

(56) References Cited

U.S. PATENT DOCUMENTS

2008/0136860 A1 6/2008 Kyoso
2010/0066787 A1 3/2010 Yokouchi et al.
2011/0227971 A1 9/2011 Hoshino

FOREIGN PATENT DOCUMENTS

DE 102005031646 A1 1/2007
JP 2008-142910 A 6/2008
(Continued)

OTHER PUBLICATIONS

International Search Report (Form PCT/ISA/210) dated Sep. 8, 2015, issued for PCT/JP2015/068365.
(Continued)

*Primary Examiner* — Jannelle M Lebron
(74) *Attorney, Agent, or Firm* — Volpe and Koenig, P.C.

(57) ABSTRACT

A flow channel member comprises a plurality of discharge elements; a plurality of first discrete flow channels; a plurality of second discrete flow channels 14; a first common flow channel extending from one side to another side in a first direction and connected commonly to the plurality of first discrete flow channels; a first opening that connects the first common flow channel and an outside; a second common flow channel extending from the one side D1*a* to the other side in the first direction and connected commonly to the plurality of second discrete flow channels; and a second opening that connects the second common flow channel and the outside. The first opening is located on the one side of the first common flow channel in the first direction, and the
(Continued)

second opening is located on the one side of the second common flow channel in the first direction.

16 Claims, 13 Drawing Sheets

(51) Int. Cl.
*B41J 2/21* (2006.01)
*B41J 29/02* (2006.01)

(52) U.S. Cl.
CPC ..... *B41J 2002/14419* (2013.01); *B41J 2002/14459* (2013.01); *B41J 2002/14491* (2013.01); *B41J 2202/12* (2013.01); *B41J 2202/21* (2013.01)

(58) Field of Classification Search
USPC ..... 347/20, 40, 65, 84–86
See application file for complete search history.

(56) References Cited

FOREIGN PATENT DOCUMENTS

| | | | |
|---|---|---|---|
| JP | 2012-006350 | A | 1/2012 |
| JP | 2012-250503 | A | 12/2012 |

OTHER PUBLICATIONS

Written Opinion (Form PCT/ISA/237) dated Sep. 8, 2015, issued for PCT/JP2015/068365.
Extended European Search Report, European Application No. 15810832.4, dated Feb. 15, 2018, 7 pgs.

FLOW CHANNEL MEMBER, LIQUID DISCHARGE HEAD, AND RECORDING DEVICE

TECHNICAL FIELD

The present invention relates to a flow channel member, a liquid discharge head, and a recording device.

BACKGROUND ART

Hitherto, a known example of a liquid discharge head uses a flow channel member including a plurality of discharge elements that discharges liquid; first discrete flow channels, each allocated for each one of the discharge elements; second discrete flow channels, each allocated for each one of the discharge elements; a first common flow channel extending from one side to another side in a first direction and connected commonly to the first discrete flow channels; a first opening for connecting the first common flow channel and the outside; a second common flow channel extending from the one side to the other side in the first direction and connected commonly to the second discrete flow channels; and a second opening for connecting the second common flow channel and the outside (see, for example, FIG. 12 in PTL 1). The discharge elements hold a meniscus of the liquid, and, on the basis of a signal transmitted from the outside, the liquid discharge head is driven to perform printing.

CITATION LIST

Patent Literature

PTL 1: Japanese Unexamined Patent Application Publication No. 2012-250503

SUMMARY OF INVENTION

Technical Problem

However, in the liquid discharge head in PTL 1, the range of distribution of pressure that is applied to each discharge element becomes large, as a result of which it may not be possible to hold the meniscus of the liquid.

Solution to Problem

A flow channel member according to an embodiment of the present invention comprises a plurality of discharge elements that discharges liquid; a plurality of first discrete flow channels, each allocated for each one of the discharge elements; a plurality of second discrete flow channels, each allocated for each one of the discharge elements; a first common flow channel extending from one side to another side in a first direction and connected commonly to the plurality of first discrete flow channels; a first opening that connects the first common flow channel and an outside; a second common flow channel extending from the one side to the other side in the first direction and connected commonly to the plurality of second discrete flow channels; and a second opening for connecting the second common flow channel and the outside. The first opening is located on the one side of the first common flow channel in the first direction. The second opening is located on the one side of the second common flow channel in the first direction.

A liquid discharge head according to an embodiment of the present invention comprises the flow channel member, and a compressing portion located on the flow channel member and configured to compress the discharge elements.

A recording device according to an embodiment of the present invention comprises the liquid discharge head, a transporting section that transports a recording medium with respect to the liquid discharge head, and a control section that controls the liquid discharge head.

Advantageous Effects of Invention

It is possible to reduce the range of distribution of pressure that is applied to each discharge element, and to hold a meniscus of a liquid.

DESCRIPTION OF EMBODIMENTS

First Embodiment

Figure 1A:
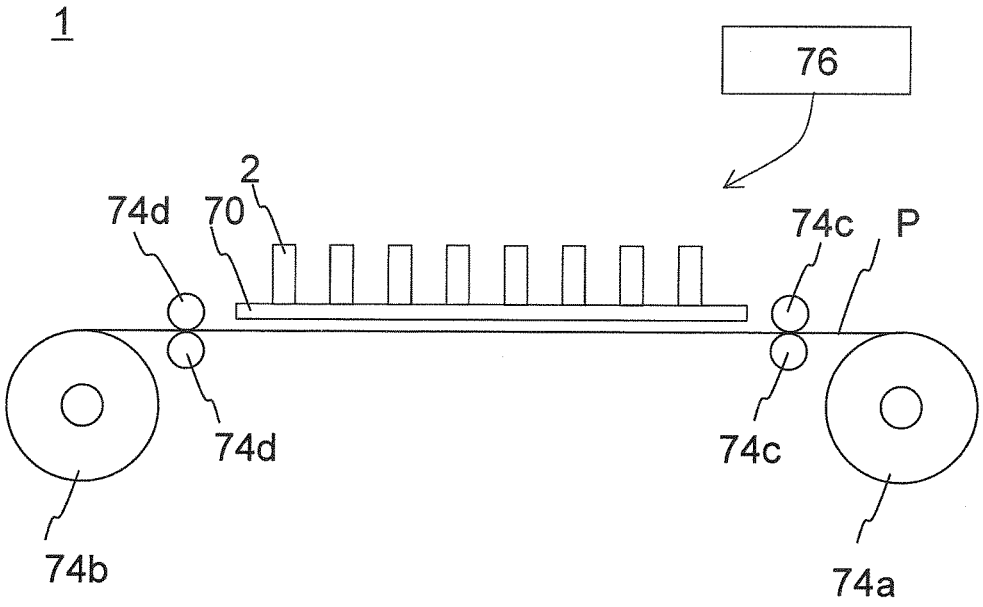
FIGS. 1(*a*) and 1(*b*) are a side view and a plan view, respectively, of a recording device including a liquid discharge head according to a first embodiment.
Figure 1B:
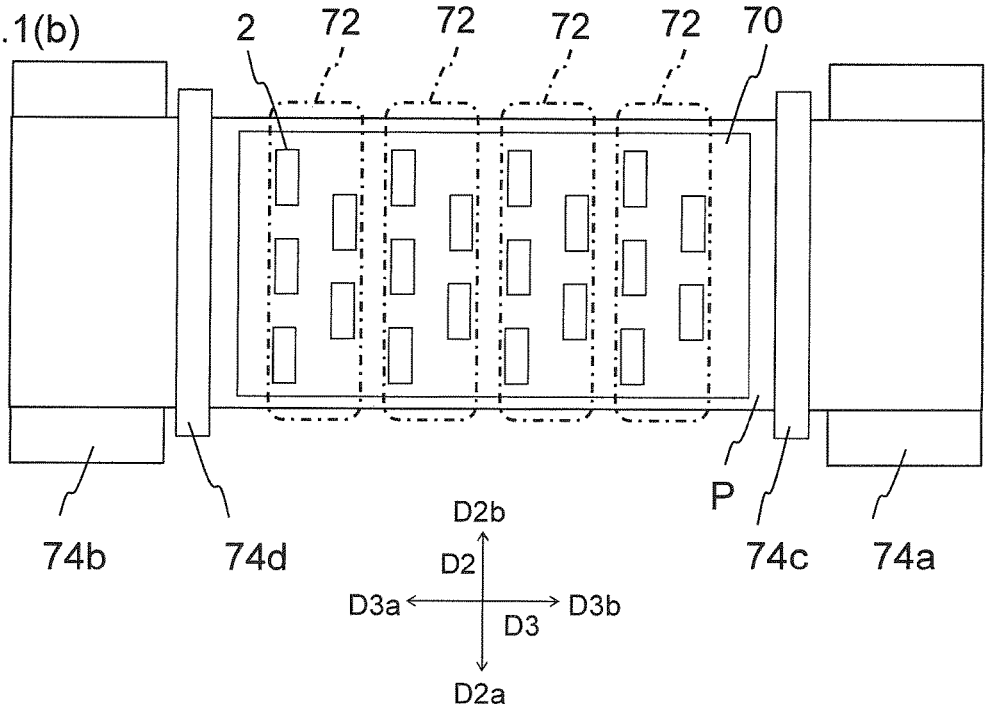

A color inkjet printer 1 (hereunder referred to as the "printer 1") including liquid discharge heads 2 according to a first embodiment is described by using FIG. 1.

The printer 1 moves a recording medium P relative to the liquid discharge heads 2 by transporting the recording medium P from a transport roller 74*a* to a transport roller 74*b*. A control section 76 controls the liquid discharge heads 2 on the basis of image or character data to cause the liquid discharge heads 2 to discharge liquid towards the recording medium P, and liquid droplets to land on the recording medium P, as a result of which printing is performed on the recording medium P.

In the present embodiment, the liquid discharge heads 2 are fixed to the printer 1. The printer 1 is a so-called line printer. A recording device according to another embodiment may be a so-called serial printer.

A flat plate-shaped head mounting frame 70 is fixed to the printer 1 such that the frame 70 is substantially parallel to the recording medium P. The head mounting frame 70 has twenty holes (not shown), and twenty liquid discharge heads 2 are placed in the holes. Five liquid discharge heads 2 form one head group 72. Accordingly, the printer 1 includes four head groups 72.

As shown in FIG. 1(*b*), each liquid discharge head 2 has a long and narrow shape. In one head group 72, three liquid discharge heads 2 are arranged side by side in a direction crossing a transport direction of the recording medium P, the remaining two liquid discharge heads 2 are displaced in the transport direction, and each of the two remaining liquid discharge heads 2 is disposed between the three liquid discharge heads 2. The liquid discharge heads 2 that are adjacent to each other are disposed such that printable areas printable by the liquid discharge heads 2 are connected to each other or overlap at the ends, in a width direction of the recording medium P. Thus, printing without gaps in the width direction of the recording medium P can be performed.

The four head groups 72 are disposed in the transport direction of the recording medium P. Ink is supplied to each liquid discharge head 2 from a liquid tank (not shown). Ink of the same color is supplied to the liquid discharge heads 2 belonging to one head group 72. The four heads groups perform printing by using four colors. The colors of the inks discharged from the corresponding head groups 72 are, for example, magenta (M), yellow (Y), cyan (C), and black (K).

If monochrome printing is to be performed over an area printable by one liquid discharge head 2, the number of liquid discharge heads 2 to be mounted on the printer 1 may be one. The number of liquid discharge heads 2 belonging to each head group 72, or the number of head groups 72 may be changed as appropriate depending upon the printing subject and the printing conditions. For example, the number of head groups 72 may be increased to increase the number of colors to be printed. When a plurality of head groups 72 that performs printing in the same color is disposed and caused to perform printing alternately in the transport direction, the printing speed, that is, the transport speed can be increased. Alternatively, a plurality of head groups 72 that performs printing in the same color may be displaced to each other in a direction crossing the transport direction to increase the resolution in the width direction of the recording medium P.

Further, instead of performing printing by using colored ink, surface treatment for the recording medium P may be performed by applying liquid, such as a coating agent.

The printer 1 performs printing on the recording medium P. The recording medium P is wound around the transport roller 74*a*. The recording medium P passes through a space between two transport rollers 74*c*, and, then, passes below the liquid discharge heads 2 mounted on the head mounting frame 70. Thereafter, the recording medium P passes through a space between two transport rollers 74*d*, and is finally wound around the transport roller 74*b*.

The recording medium P may be, for example, a cloth instead of a print sheet. The printer 1 may be a transport-belt transporting type instead of a recording-medium-P transporting type. The recording medium may be, in addition to a roll, a cut sheet, a cut piece of cloth, a wood piece, a tile, etc., on the transport belt. Further, the liquid discharge heads 2 may discharge liquid containing conductive particles to print, for example, a wiring pattern of an electronic device. Still further, for example, the liquid discharge heads 2 may discharge a predetermined amount of liquid chemical agent or a liquid containing a chemical agent towards a reactor vessel or the like to generate a reaction for producing a chemical.

Position sensors, speed sensors, temperature sensors, etc., may be mounted on the printer 1. The control section 76 may control each part of the printer 1 in accordance with the states of the parts of the printer 1 that can be known from information from the sensors. In particular, if the discharge characteristics of the liquid that is discharged from the liquid discharge heads 2 (such as the discharge amount and the discharge speed) are subjected to external influences, driving signals used to discharge the liquid by the liquid discharge heads 2 may be changed in accordance with the temperature of the liquid discharge heads 2, the temperature of the liquid in the liquid tank, and the pressure that is applied to each liquid discharge head 2 by the liquid of the liquid tank.

Figure 2:
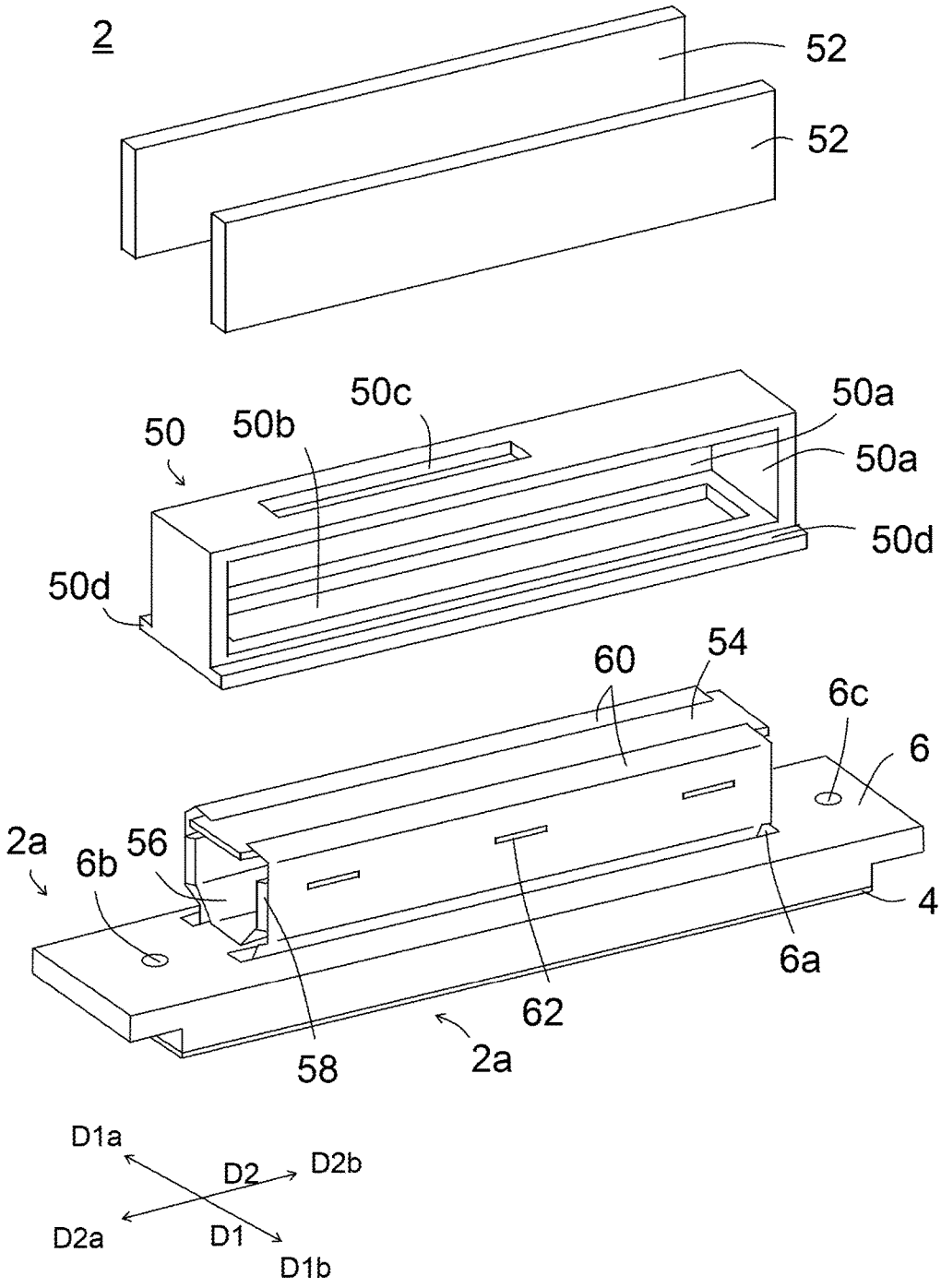
FIG. 2 is an exploded perspective view of the liquid discharge head in FIG. 1.
Figure 3A:
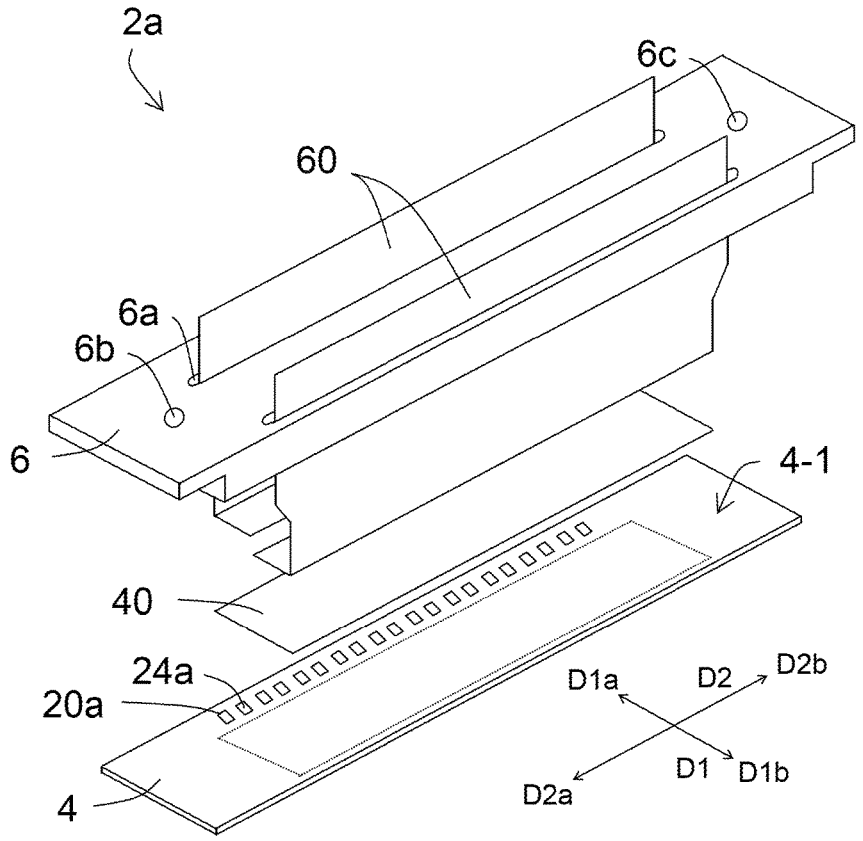
FIGS. 3(*a*) and 3(*b*) are an exploded perspective view and a sectional view, respectively, of a head body in FIG. 2.
Figure 3B:
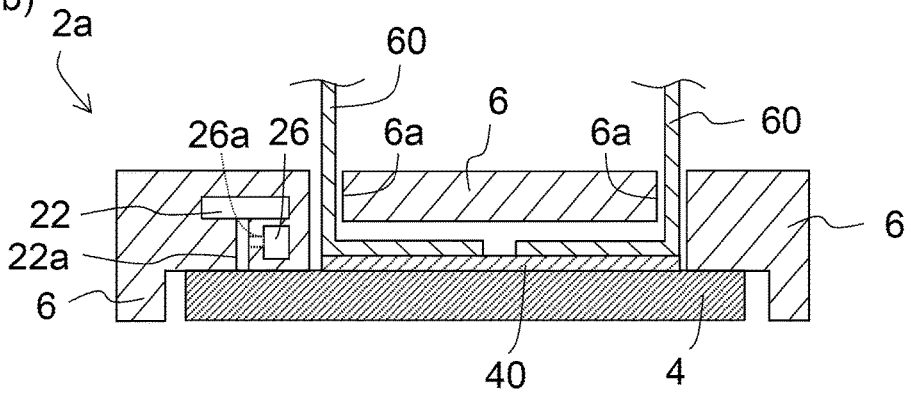
Figure 4:
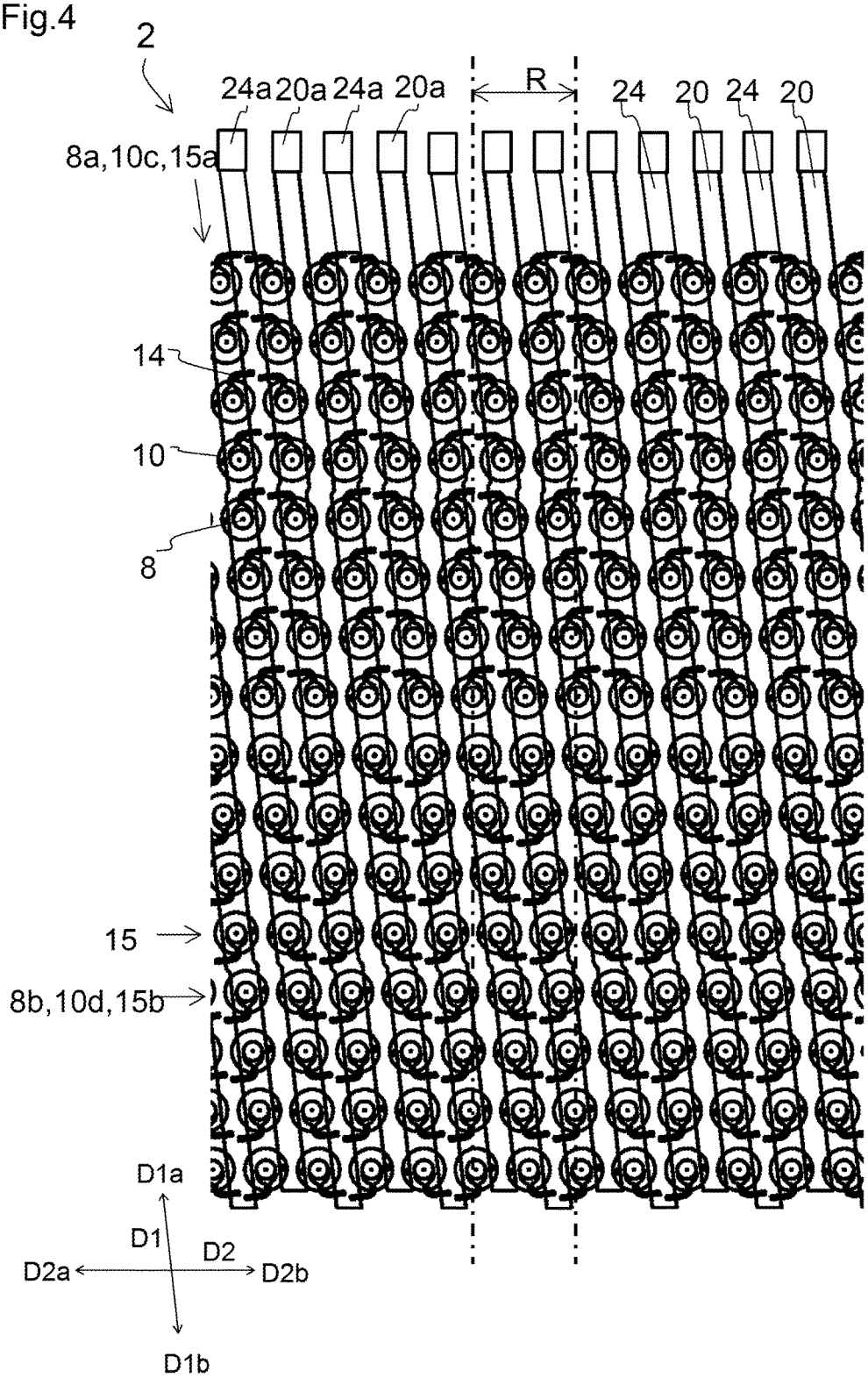
FIG. 4 is an enlarged plan view of part of the liquid discharge head in FIG. 2.
Figure 5A:
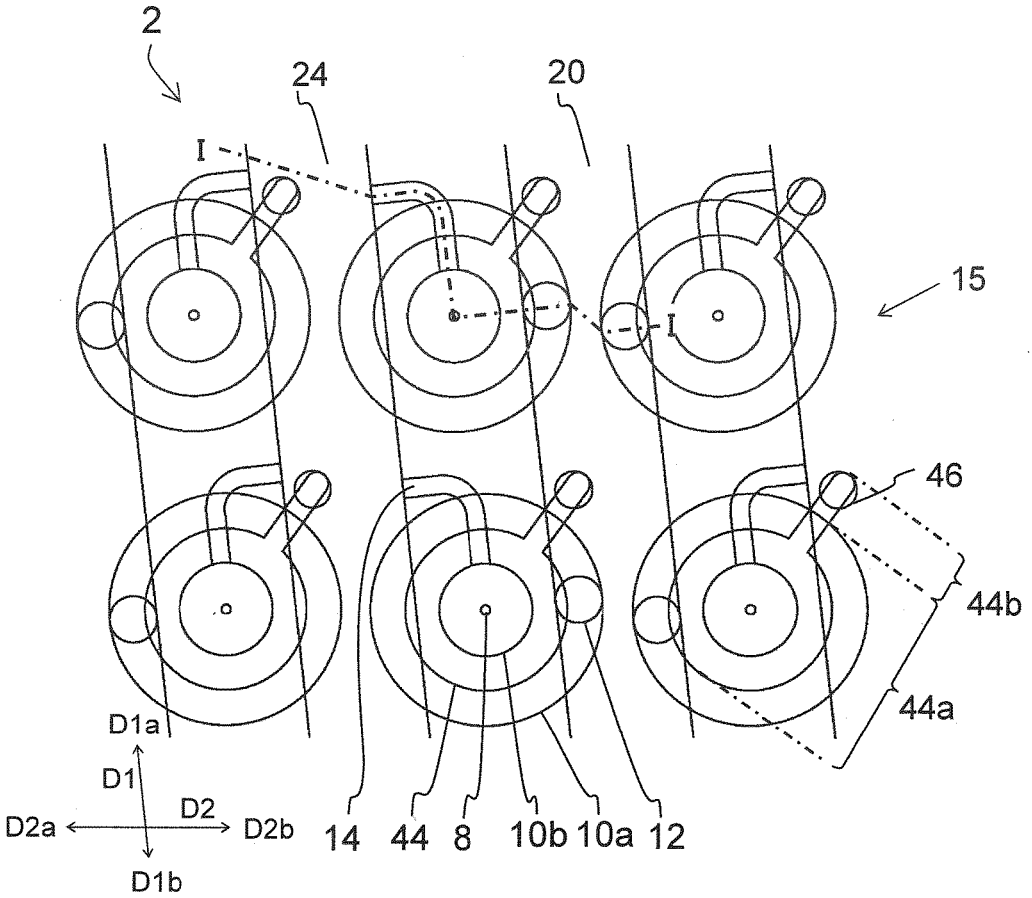
FIG. 5(*a*) is an enlarged plan view of discharge elements in FIG. 4, and FIG. 5(*b*) is a sectional view taken along line I-I in FIG. 5(*a*).
Figure 5B:
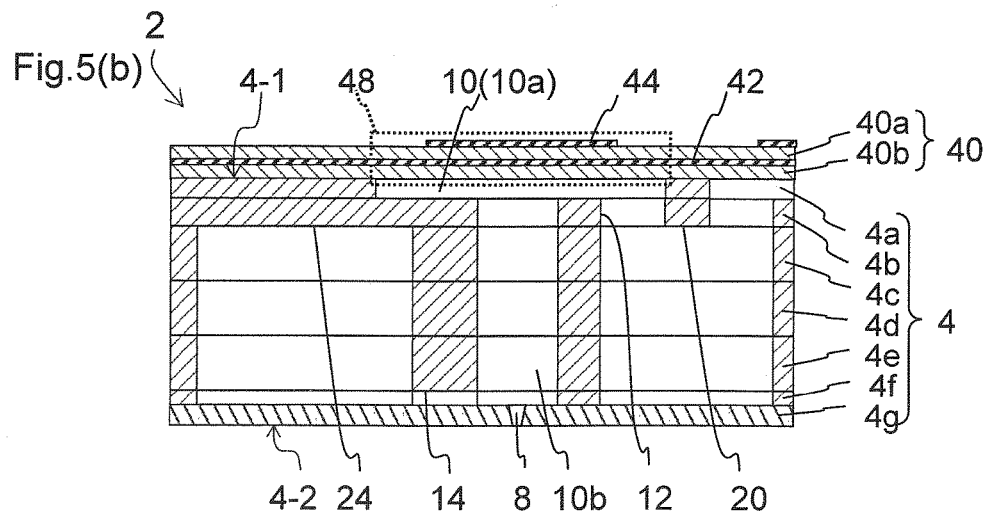

Next, a liquid discharge head 2 according to the first embodiment is described by using FIGS. 2 to 9. In the present embodiment, a flow channel member is described as a first flow channel member 4, a reservoir is described as a second flow channel member 6, third common flow channels are described as first integrated flow channels 22, fourth common flow channels are described as second integrated flow channels 26, and compressing portions are described as displacement elements 48. In FIGS. 4 and 5, flow channels, etc., which are disposed below other members and are to be drawn by broken lines, are drawn with solid lines to facilitate understanding of the figures.

A first direction D1, a second direction D2, and a third direction D3 are shown in the figures. The first direction D1 is a direction in which first common flow channels 20 and second common flow channels 24 extend. The first common flow channels 20 and the second common flow channels 24 extend from one side D1*a* to another side D1*b* in the first direction D1. The second direction D2 is a direction in which the first integrated flow channels 22 and the second integrated flow channels 26 extend. The first integrated flow channels 22 and the second integrated flow channels 26 extend from one side D2*a* to another side D2*b* in the second direction D2. The third direction D3 is a direction orthogonal to the second direction D2, and is defined by a first side D3*a* and another side D3*b*.

As shown in FIG. 2, the liquid discharge head 2 includes a head body 2*a*. The liquid discharge head 2 further includes a housing 50, heat-dissipation plates 52, a wiring board 54, a pressing member 56, an elastic member 58, a signal transmitting member 60, and a driver IC 62. The liquid discharge head 2 need not necessarily include the housing 50, the heat-dissipation plates 52, the wiring board 54, the pressing member 56, the elastic member 58, the signal transmitting member 60, and the driver IC 62.

In the liquid discharge head 2, the signal transmitting member 60 is drawn out from the head body 2*a*, and the signal transmitting member 60 is electrically connected to the wiring board 54. The driver IC 62 that controls driving of the liquid discharge head 2 is disposed on the signal transmitting member 60. The driver IC 62 is pressed against the heat-dissipation plates 52 by the pressing member 56 via the elastic member 58. A supporting member that supports the wiring board 54 is not illustrated.

The heat-dissipation plates 52 may be made of a metal or an alloy, and are provided for dissipating the heat of the driver IC 62 to the outside. The heat-dissipation plates 52 are joined to the housing 50 by using a screw or an adhesive.

The housing 50 is placed on the head body 2*a*. Each member of the liquid discharge head 2 is covered by the housing 50 and the heat-dissipation plates 52. The housing 50 has openings 50*a*, an opening 50*b*, and an opening 50*c*, and a heat-insulation portion 50*d*. The openings 50*a* are located in side surfaces that are opposite each other in the third direction D3 of the housing 50. The heat-dissipation plates 52 are disposed at the openings 50*a*. The opening 50*b* opens downward. The wiring board 54 and the pressing member 56 are disposed in the housing 50 via the opening 50*b*. The opening 50*c* opens upward. A connector (not show) disposed at the wiring board 54 is accommodated in the opening 50*c*.

The heat-insulation portion 50*d* extends from the one side D2*a* to the other side D2*b* in the second direction D2, and is disposed between the heat-dissipation plates 52 and the head body 2*a*. Therefore, the heat dissipated at the heat-dissipation plates 52 can reduce the probability with which the heat is transferred to the head body 2*a*. The housing 50 may be made of a metal, an alloy, or a resin.

As shown in FIG. 3(*a*), the head body 2*a* is a flat plate-shaped body that is long in the second direction D2, and includes the first flow channel member 4, the second flow channel member 6, and a piezoelectric actuator substrate 40. In the head body 2*a*, the piezoelectric actuator substrate 40 and the second flow channel member 6 are disposed on the first flow channel member 4. The piezoelectric actuator substrate 40 is placed on an area, indicated by broken lines, on the first flow channel member 4 in FIG. 3(*a*). The piezoelectric actuator substrate 40 is provided for compressing a plurality of compression chambers 10 (see FIG. 5(*b*)), disposed at the first flow channel member 4, and includes the plurality of displacement elements 48 (see FIG. 5(*b*)).

The first flow channel member 4 includes flow channels in its interior, and guides liquid supplied from the second flow channel member 6 up to discharge holes 8. A compression chamber surface 4-1 is formed at one of the principal surfaces of the first flow channel member 4, and openings 20*a* and 24*a* are formed in the compression chamber surface 4-1. The openings 20*a* are arranged in the second direction D2, and are disposed on the one side D1*a* of the compression chamber surface 4-1 in the first direction D1. The openings 24*a* are arranged in the second direction D2, and are disposed on the one side D1*a* of the compression chamber surface 4-1 in the first direction D1.

The second flow channel member 6 includes flow channels in its interior, and guides liquid supplied from the liquid tank up to the first flow channel member 4. The second flow channel member 6 is disposed on an outer peripheral portion of the compression chamber surface 4-1 of the first flow channel member 4, and is joined to the first flow channel member 4 with an adhesive (not shown) at an outer side of an area where the piezoelectric actuator substrate 40 is placed.

As shown in FIG. 3, the second flow channel member 6 includes through holes 6*a*, an opening 6*b*, an opening 6*c*, the first integrated flow channels 22, and the second integrated flow channels 26. The through holes 6*a* extend in the second direction D2, and are disposed at an outer side of the area where the piezoelectric actuator substrate 40 is placed. The signal transmitting member 60 is inserted in the through holes 6*a*.

The opening 6*b* is located in an upper surface of the second flow channel member 6, and is disposed on the one side D2*a* of the second flow channel member 6 in the second direction D2. The opening 6*b* allows liquid to be supplied to the second flow channel member 6 from the liquid tank. The opening 6*c* is located in the upper surface of the second flow channel member 6, and is disposed on the other side D2*b* of the second flow channel member 6.

The first integrated flow channels 22 extend in the second direction D2, and each include a first connection flow channel 22*a*. Each first connection flow channel 22*a* connects the opening 6*b* and the openings 20*a*, and allows liquid to be supplied to the first flow channel member 4 via the first integrated flow channels 22.

The second integrated flow channels 26 extend in the second direction D2, and each include a second connection flow channel 26*a*. The second connection flow channels 26*a* connect the opening 6*c* and the openings 24*a*, and collect liquid from the first flow channel member 4 via the second integrated flow channels 26. The second flow channel member 6 need not necessarily be provided.

As shown in FIG. 5(*b*), the first flow channel member 4 is formed by stacking a plurality of plates 4*a* to 4*g* upon each other, and includes the compression chamber surface 4-1 and a discharge hole surface 4-2. The piezoelectric actuator substrate 40 is placed on the compression chamber surface 4-1, and liquid is discharged from the discharge holes 8 in the discharge hole surface 4-2. The plurality of plates 4*a* to 4*g* may each be made of a metal, an alloy, or a resin. The first flow channel member 4 may be integrally formed of resin without stacking the plurality of plates 4*a* to 4*g* upon each other.

The first flow channel member 4 includes the plurality of first common flow channels 20, the plurality of first openings 20*a*, the plurality of second common flow channels 24, the plurality of second openings 24*a*, a plurality of discharge elements 15, a plurality of first discrete flow channels 12, and a plurality of second discrete flow channels 14. The openings 20*a* and the openings 24*a* are formed in the compression chamber surface 4-1.

The first common flow channels 20 extend from the one side D1*a* to the other side D1*b* in the first direction D1, and are connected to the openings 20*a* on the one side D1*a* in the first direction D1. The first common flow channels 20 are arranged in the second direction D2.

The second common flow channels 24 extend from the one side D1*a* to the other side D1*b* in the first direction D1, and are connected to the openings 24*a* on the one side D1*a* in the first direction D1. The plurality of second common flow channels 24 are arranged in the second direction D2, and are each disposed between the first common flow channels 20 that are adjacent to each other in the second direction D2. Therefore, the first common flow channels 20 and the second common flow channels 24 extend in the first direction D1, and are disposed side by side in the second direction D2.

Figure 6:
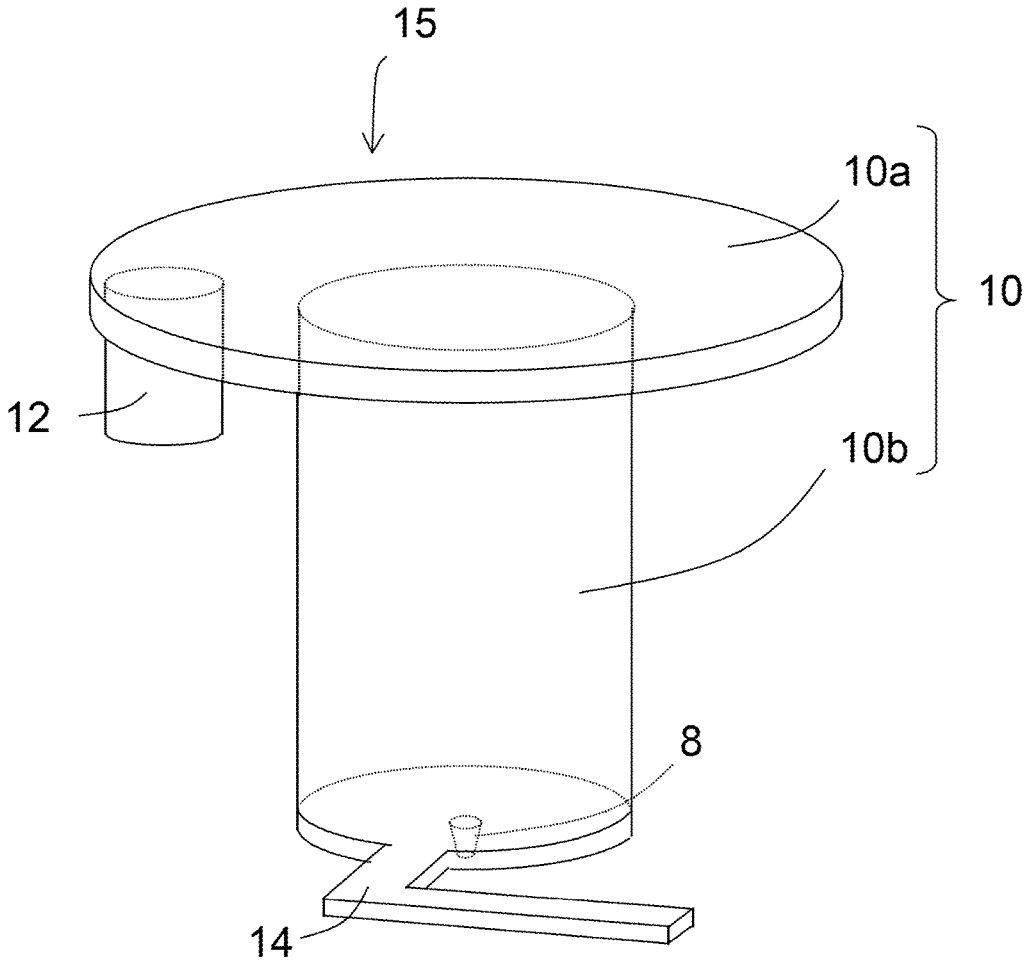
FIG. 6 is an enlarged perspective view of a discharge element in FIG. 2.

As shown in FIGS. 4 and 6, the discharge elements 15 each include the discharge hole 8 and the compression chamber 10, and the first discrete flow channels 12 and the second discrete flow channels 14 are connected to the compression chambers 10. The discharge elements 15 are each disposed between the first common flow channel 20 and the second common flow channel 24 that are adjacent to each other, and are formed in a matrix in a planar direction of the first flow channel member 4. The discharge elements 15 include discharge element columns 15*a* and discharge element rows 15*b*. The discharge element columns 15*a* are arranged in the first direction D1, and the discharge element rows 15*b* are arranged in the second direction D2. Similarly to the discharge element columns 15*a*, compression chamber columns 10*c* and discharge hole columns 8*a* are also arranged in the first direction D1. Similarly to the discharge element rows 15*b*, compression chamber rows 10*d* and discharge hole rows 8*b* are also arranged in the second direction D2.

The angle that is defined by the first direction D1 and the second direction D2 deviates from a right angle. Therefore, the discharge holes 8 belonging to the discharge hole columns 8*a* disposed in the first direction are displaced to each other in the second direction D2 in correspondence with the deviation from the right angle. Since the discharge hole columns 8*a* are disposed side by side in the second direction D2, the discharge holes 8 belonging to different discharge hole columns 8*a* are correspondingly displaced in the second direction D2. Accordingly, the discharge holes 8 in the first flow channel member 4 are disposed side by side at a constant interval in the second direction D2. Therefore, it is possible to perform printing such that a predetermined area is embedded with pixels formed by discharged liquid.

In FIG. 4, when the discharge holes 8 are projected in the third direction D3 orthogonal to the second direction D2, 32 discharge holes 8 are projected in an area defined by an imaginary straight line R, and the discharge holes 8 within the imaginary line R are disposed side by side at an interval of 360 dpi. Therefore, if the recording medium P is transported in a direction orthogonal to the imaginary straight line R and printing is performed, it is possible to perform printing at a resolution of 360 dpi.

In the liquid discharge head 2, liquid is supplied to the compression chambers 10 from the first discrete flow channels 12, and the second discrete flow channels 14 collect the liquid from the compression chambers 10.

The compression chambers 10 each include a compression chamber body 10*a* and a partial flow channel 10*b*. Each compression chamber body 10*a* is circular in plan view, and each partial flow channel 10*b* extends downward from the center of the corresponding compression chamber body 10*a*. The compression chamber bodies 10*a* are formed such that, when the compression chamber bodies 10*a* are subjected to pressure from the displacement elements 48 (see FIG. 5) on the compression chamber bodies 10*a*, pressure is applied to liquids in the compression chambers 10.

Each compression chamber body 10*a* has a circular cylindrical shape, and has a planar shape that is circular. When the planar shape is circular, displacement amounts and changes in the volumes of the compression chambers 10, caused by the displacements, can be made large.

Each partial flow channel 10*b* has a circular cylindrical shape whose diameter is smaller than that of the corresponding compression chamber body 10*a*, and has a planar shape that is circular. When seen from the compression chamber surface 4-1, each partial flow channel 10*b* is disposed at an inner side of the corresponding compression chamber body 10*a*. Each partial flow channel 10*b* connects the corresponding compression chamber body 10*a* and the corresponding discharge hole 8.

Each partial flow channel 10*b* may have a conical shape or a trapezoidal conical shape whose sectional area decreases towards the discharge hole 8. This makes it possible to increase channel resistances of the first common flow channels 20 and the second common flow channels 24 and to reduce differences in pressure losses.

The compression chambers 10 are disposed along two sides of each first common flow channel 20. One column thereof is formed on each side, so that a total of two compression chamber columns 10*c* are formed. Each first common flow channel 20 and the corresponding compression chambers 10, disposed side by side on the two sides of the corresponding first common flow channel 20, are connected to each other via the corresponding first discrete flow channels 12.

The compression chambers 10 are disposed along two sides of each second common flow channel 24. One column thereof is formed on each side, so that a total of two compression chamber columns 10*c* are formed. Each second common flow channel 24 and the corresponding compression chambers 10, disposed side by side on the two sides of the corresponding second common flow channel 24, are connected to each other via the corresponding second discrete flow channels 14.

The first discrete flow channels 12 connect the first common flow channels 20 and the compression chamber bodies 10*a*. The first discrete flow channels 12 each extend upward from an upper surface of the corresponding first common flow channel 20, and, then, is connected to a lower surface of the corresponding compression chamber body 10*a*.

The second discrete flow channels 14 connect the second common flow channels 24 and the partial flow channels 10*b*. The second discrete flow channels 14 each extend in the second direction D2 from a lower surface of the corresponding second common flow channel 24, then, extends in the first direction D1, and, then, is connected to a side surface 10*b* of the corresponding partial flow channel 10*b*.

Circulation of liquid in a liquid discharge head is described. Liquid is supplied from the liquid tank, disposed at the outside, to the second flow channel member 6 via the opening 6*b*. The liquid supplied to the opening 6*b* is supplied to the first integrated flow channels 22, and is supplied to the first flow channel member 4 via the openings 20*a*. The liquid supplied to the first common flow channels 20 via the openings 20*a* flows into the compression chamber bodies 10*a* via the first discrete flow channels 12, and is supplied to the partial flow channels 10*b*. Part of the liquid is discharged from the discharge holes 8. Then, the remaining liquid is collected by the second common flow channels 24 from the partial flow channels 10*b* via the second discrete flow channels 14, and is collected by the second flow channel member 6 from the first flow channel member 4 via the openings 24*a*. The liquid collected by the second flow channel member 6 via the openings 24*a* flows through the second integrated flow channels 26, and is collected by the outside via the opening 6*c*.

The piezoelectric actuator substrate 40 including the displacement elements 48 is joined to an upper surface of the first flow channel member 4. The displacement elements 48 are disposed so as to be positioned on the respective compression chambers 10. The piezoelectric actuator substrate 40 occupies an area having a shape that is substantially the same as that of a compression chamber group including the compression chambers 10. An opening in each compression chamber 10 is closed by joining the piezoelectric actuator substrate 40 to the compression chamber surface 4-1 of the first flow channel member 4.

The piezoelectric actuator substrate 40 includes a multilayer structure including two piezoelectric ceramic layers 40*a* and 40*b*, which are piezoelectric bodies. The piezoelectric ceramic layers 40*a* and 40*b* each have a thickness of approximately 20 μm. The piezoelectric ceramic layers 40*a* and 40*b* each extend over a plurality of the compression chambers 10.

The piezoelectric ceramic layers 40*a* and 40*b* are made of a ferroelectric ceramic material, such as a lead zirconate titanate (PZT) based, $NaNbO_3$ based, $BaTiO_3$ based, (BiNa)$NbO_3$ based, or $BiNaNb_5O_{15}$ based ceramic material. The piezoelectric ceramic layer 40*b* serves as a vibration substrate, and need not necessarily be made of a piezoelectric material. The piezoelectric ceramic layer 40*b* may be replaced by, for example, a ceramic layer that is not composed of a piezoelectric material or a metal plate.

The piezoelectric actuator substrate 40 includes a common electrode 42, discrete electrodes 44, and connecting electrodes 46. The common electrode 42 is formed over substantially the entire surface of an area between the piezoelectric ceramic layer 40*a* and the piezoelectric ceramic layer 40*b* in a surface direction. The discrete electrodes 44 are disposed so as to oppose the compression chambers 10 on an upper surface of the piezoelectric actuator substrate 40.

Portions of the piezoelectric ceramic layer 40*a* that are interposed between the discrete electrodes 44 and the common electrode 42 are polarized in a thickness direction, and serve as the displacement elements 48 having a unimorph structure that are displaced when a voltage is applied to the discrete electrodes 44. Therefore, the piezoelectric actuator substrate 40 includes the plurality of displacement elements 48.

The common electrode 42 may be made of a metal material such as an Ag—Pd-based material, and may have a thickness of approximately 2 μm. The common electrode 42 is provided with a common-electrode surface electrode (not shown) on the piezoelectric ceramic layer 40*a*. The common-electrode surface electrode is connected to the common electrode 42 via a via hole formed through the piezoelectric ceramic layer 40*a*, is connected to ground, and is maintained at the ground potential.

The discrete electrodes 44 are each made of a metal material, such as an Au-based material, and each include a discrete electrode body 44*a* and a lead electrode 44*b*. As shown in FIG. 5(*a*), the discrete electrode bodies 44*a* are each substantially circular in plan view, and are each smaller than the corresponding compression chamber body 10*a*. Each lead electrode 44*b* is led out from the corresponding discrete electrode body 44*a*. Each connecting electrode 46 is formed on the corresponding lead electrode 44*b* that has been led out.

Each connecting electrode 46 is made of, for example, silver-palladium including glass frit, and has a convex shape having a thickness of approximately 15 μm. Each connecting electrode 46 is electrically joined to an electrode disposed at the signal transmitting member 60.

Next, a liquid discharge operation is described. The displacement elements 48 are displaced in response to drive signals that are supplied to the discrete electrodes 44 via, for example, the driver IC 62 under control of the control section 76. As a driving method, a so-called pulling driving method may be used.

Figure 7A:
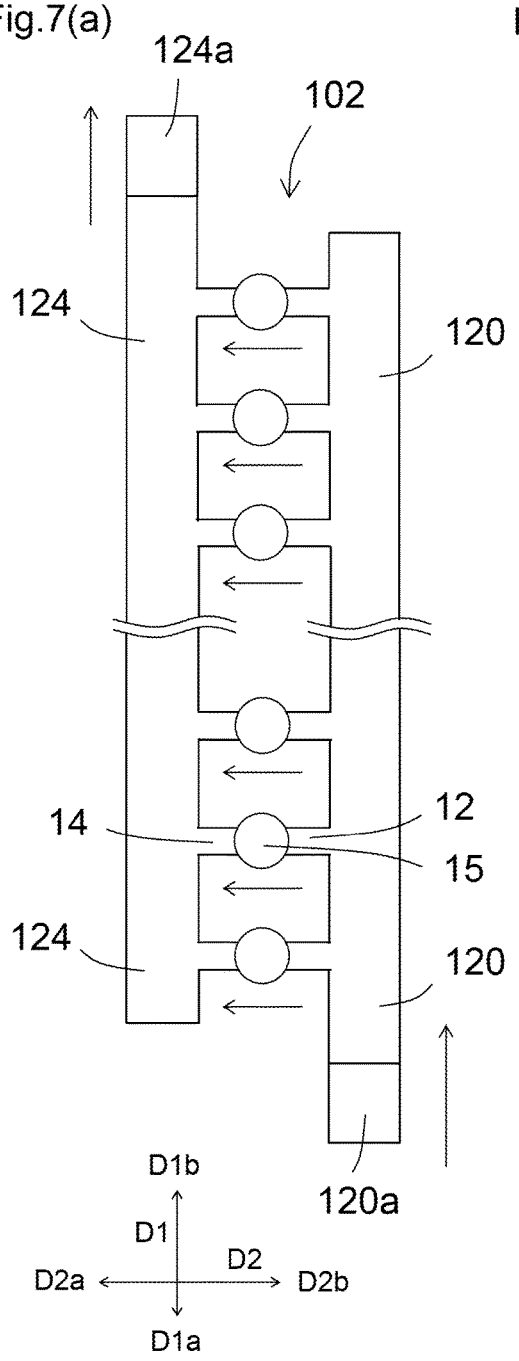
FIG. 7(*a*) is a schematic view of a schematic structure of flow channels of part of an existing liquid discharge head, and FIG. 7(*b*) is an equivalent circuit diagram of the flow channels in FIG. 7(*a*).
Figure 7B:
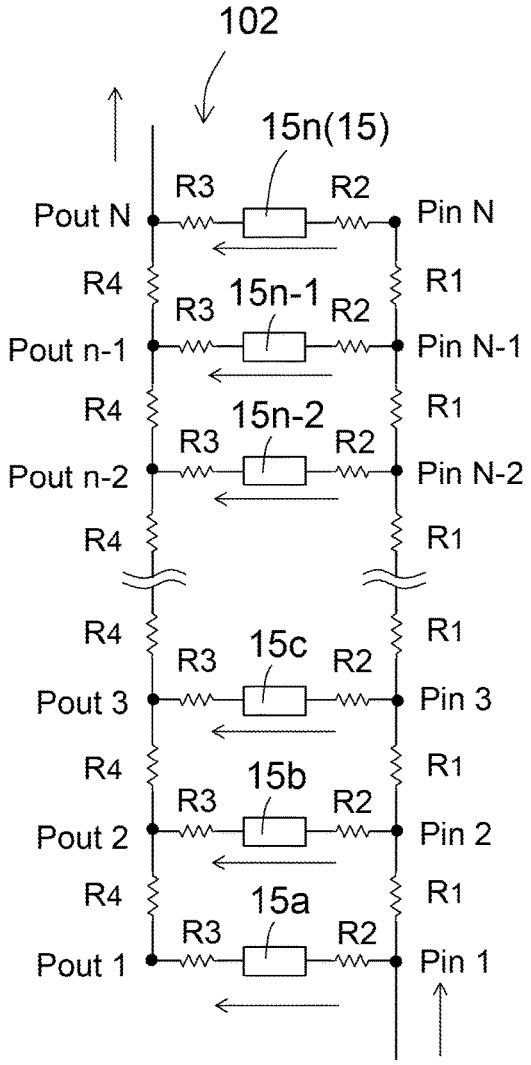
Figure 8A:
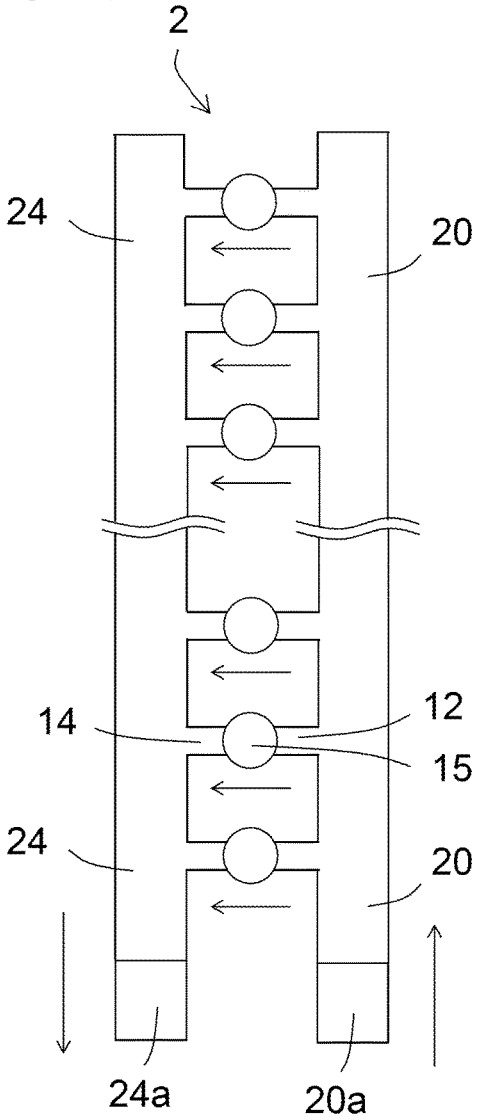
FIG. 8(*a*) is a schematic view of a schematic structure of flow channels of part of the liquid discharge head according to the first embodiment, and FIG. 8(*b*) is an equivalent circuit diagram of the flow channels in FIG. 8(*a*).
Figure 8B:
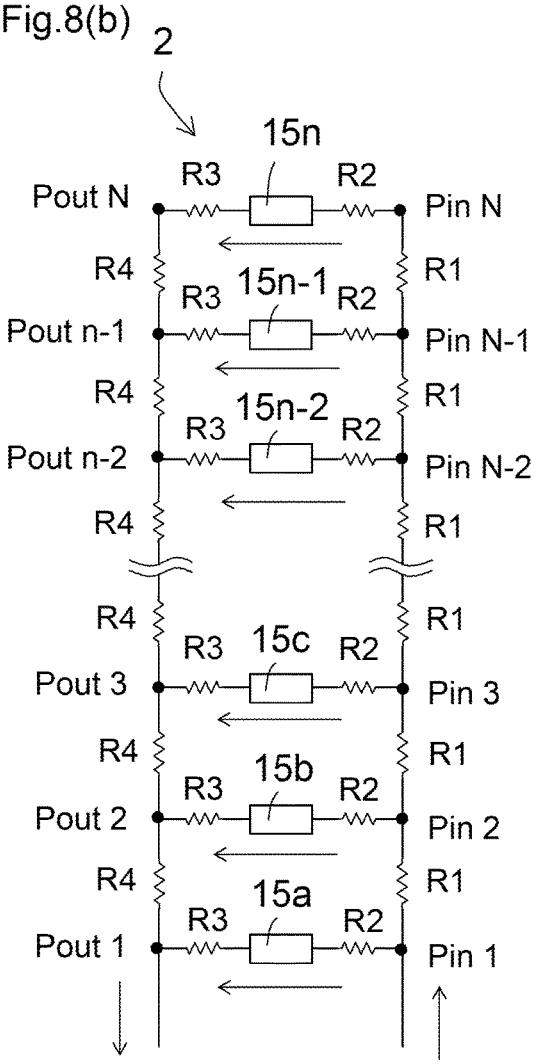
Figure 8B:
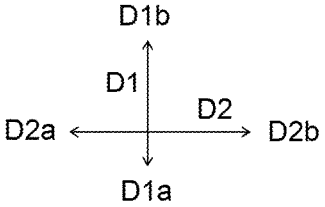
Figure 9A:
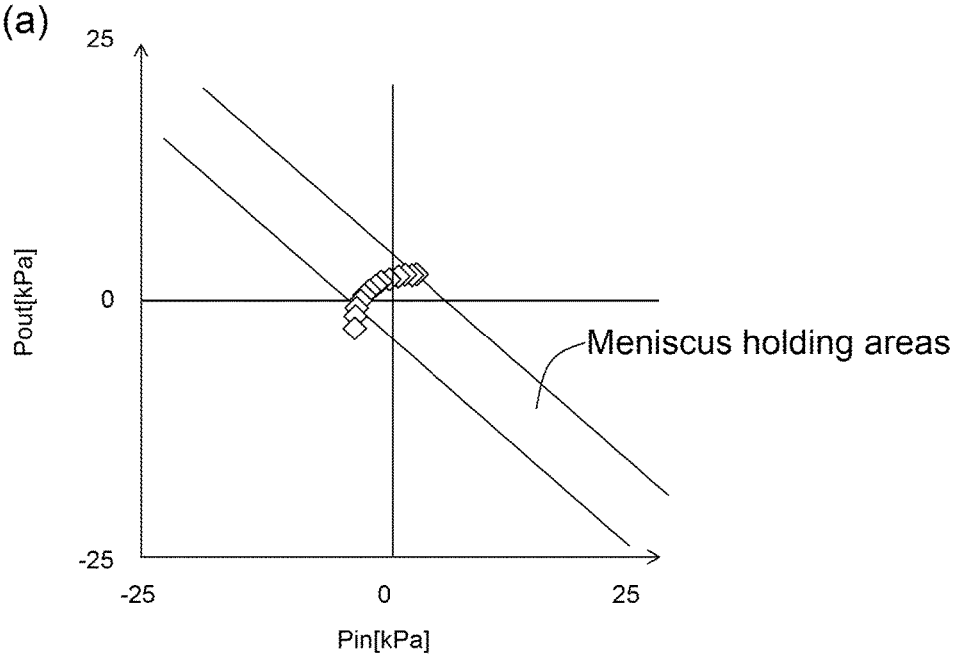
FIG. 9(*a*) illustrate a distribution of pressure that is applied to each discharge element of the liquid discharge head in FIG. 7, and FIG. 9(*b*) illustrates a distribution of pressure that is applied to each discharge element of the liquid discharge head in FIG. 8.
Figure 9B:
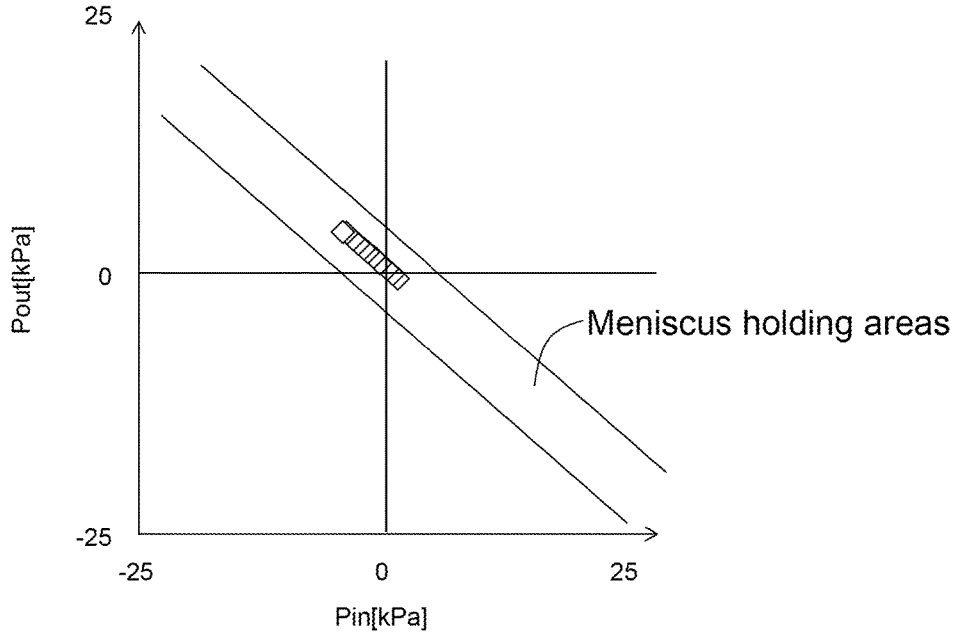

FIG. 7(*a*) illustrates a schematic structure of flow channels of part of an existing liquid discharge head 102, and FIG. 7(*b*) is an equivalent circuit diagram of the flow channels in FIG. 7(*a*). FIG. 8(*a*) illustrates a schematic structure of flow channels of part of the liquid discharge head 2 according to the present embodiment, and FIG. 8(*b*) is an equivalent circuit diagram of the flow channels in FIG. 8(*a*). FIG. 9 illustrates pressure that is applied to each discharge element 15 in the flow channels in FIG. 8(*a*) of the liquid discharge head 2 according to the present embodiment and pressure that is applied to each discharge element 15 in the flow channels in FIG. 7(*a*) of the existing liquid discharge head 102. The arrows in FIGS. 7 and 8 indicate liquid flow.

In FIGS. 7 and 8, R1 denote channel resistances of the first common flow channels. R2 denote channel resistances of the first discrete flow channels. R3 denote channel resistances of the second discrete flow channels. R4 denote channel resistances of the second common flow channels. R1 do not denote the channel resistances of the first common flow channels as a whole, but denote the channel resistances of the first common flow channels that are positioned between the first discrete flow channels 12 that are adjacent to each other. Similarly, R4 do not denote the channel resistances of the second common flow channels as a whole, but denote the channel resistances of the second common flow channels that are positioned between the second discrete flow channels that are adjacent to each other. In the present embodiment, the channel resistances R1 of the first common flow channels and the channel resistances R4 of the second common flow channels corresponding to R1 are substantially equal to each other. The channel resistances R1 of the first common flow channels and the channel resistances R4 of the second common flow channels corresponding to R1 need not be equal to each other.

In FIGS. 7 and 8, the plurality of discharge elements 15 are described by designating them as a discharge element 15*a*, a discharge element 15*b*, a discharge element 15*c*, . . . a discharge element 15*n*-2, a discharge element 15*n*-1, and a discharge element 15*n*, in that order from the one side D1*a* in the first direction D1. Pressures Pin in FIGS. 7(*b*) and 8(*b*) indicate pressures at entrance sides of the respective discharge elements 15, and pressures Pout indicate pressures at exit sides of the respective discharge elements 15. FIG. 9 is a figure in which the pressures Pin and the pressures Pout that are applied to the respective discharge elements 15 are plotted.

When the liquid discharge head does not discharge liquid, it is necessary to form a liquid meniscus at the discharge holes 8. If the pressures at inner sides of the discharge holes 8 (hereunder called the "pressures of the discharge holes 8") are substantially 0 (zero), the liquid meniscus is formed at the discharge holes 8 by the surface tension of the liquid. Since the surface tension of the liquid is provided, even if the pressures of the discharge holes 8 are slightly positive or slightly negative, the meniscus is held at the discharge holes 8. However, if the pressures of the discharge holes 8 become excessively positive, the liquid overflows from the discharge holes 8, and spreads to the discharge hole surface 4-2. In contrast, if the pressures of the discharge holes 8 become excessively negative, outside gas enters from the discharge holes 8. In either case, in such states, since pressure propagations of the pressures at the discharge elements 15 differ from usual cases, discharge characteristics of the discharge elements 15 vary. Therefore, discharge is no longer performed. Consequently, the pressures of the discharge holes 8 need to be within a predetermined pressure range near 0 (zero).

The pressures of the discharge holes 8 are pressures that are between the pressures Pin and the corresponding pressures Pout. More specifically, although differences occur due to the channel resistance values of R2 and R3, the pressures of the discharge holes 8 are pressures having center values between the pressures Pin and the corresponding pressures Pout, that is, average values of the pressures Pin and the corresponding pressures Pout. Meniscus holding areas in FIG. 9 are areas in which the average values of the pressures Pin and the corresponding pressures Pout are within a predetermined pressure range near 0 (zero). If the pressures Pin and the pressures Pout are within the corresponding meniscus holding areas, the pressures of the discharge holes 8 are within a range in which the meniscus can be held.

The existing liquid discharge head 102 differs from the liquid discharge head 2 in the arrangement of first openings 120*a* and second openings 124*a*. The first openings 120*a* are located on the one side D1*a* in the first direction D1, and the second openings 124*a* are located on the other side D1*b* in the first direction D1. Therefore, liquid flows in the direction of the arrows in FIG. 7(*a*).

Consequently, depending upon the locations of the discharge elements 15 that are connected to first common flow channels 20, the values of the pressures Pin that are applied to the discharge elements 15 differ. More specifically, due to the influence of pressure loss of the liquid flowing through the first common flow channels 20, pressure PinN of the discharge element 15*n* that is positioned on the other side D1*b* in the first direction D1 is lower than pressure Pin1 of the discharge element 15*a* that is positioned on the one side D1*a* in the first direction D1. That is, the pressures Pin that are applied to the discharge elements 15 gradually become lower towards the other side D1*b* from the one side D1*a* in the first direction D1.

Similarly to the above, depending upon the locations of the discharge elements 15 that are connected to the second common flow channels 124, the values of the pressures Pout that are applied to the discharge elements 15 differ. More specifically, due to the influence of pressure loss of the liquid flowing through the second common flow channels 124, pressure PoutN of the discharge element 15*n* that is positioned on the other side D1*b* in the first direction D1 is lower than pressure Pout1 of the discharge element 15*a* that is positioned on the one side D1*a* in the first direction D1. That is, the pressures Pout that are applied to the discharge elements 15 gradually become lower towards the other side D1*b* from the one side D1*a* in the first direction D1.

As a result, at the discharge element 15*a* that is disposed closest to the one side D1*a* in the first direction D1, the pressure Pin1 and the pressure Pout1 are both high, and the pressure at the discharge hole 8 is high. These correspond to the pressures at the uppermost right side of the graph among the pressures that are applied to the discharge elements 15 in FIG. 9(*a*). At the discharge element 15*n* that is disposed closest to the other side D1*b* in the first direction D1, the pressure PinN and the pressure PoutN are both low, and the pressure at the discharge hole 8 is low. These correspond to the pressures at the lowermost left side of the graph among the pressures that are applied to the discharge elements 15 in FIG. 9(*a*).

The relationship between the pressures Pin1 to N and the pressures Pout1 to N are as described above. Therefore, the pressures that are applied to the discharge elements 15 from the discharge element 15*a* up to the discharge element 15*n* are distributed from the upper right side to the lower left side of the graph as shown in FIG. 9(*a*). The distribution traverses the meniscus holding area. Therefore, the range of distribution of the pressure that is applied to each discharge element 15 is large, as a result of which the distribution cannot be within the meniscus holding area. Consequently, the meniscus may not be held at each discharge element 15.

In the liquid discharge head 2 in FIG. 8, the first openings 20*a* are located on the one side D1*a* in the first direction D1, and the second openings 24*a* are located on the one side D1*a* in the first direction D1. Therefore, liquid flows in the directions of the arrows in FIG. 8(*a*).

Consequently, depending upon the locations of the discharge elements 15 that are connected to the first common flow channels 20, the values of the pressures Pin that are applied to the discharge elements 15 differ. More specifically, due to the influence of pressure loss of the liquid flowing through the first common flow channels 20, pressure PinN of the discharge element 15*n* that is positioned on the other side D1*b* in the first direction D1 is lower than pressure Pin1 of the discharge element 15*a* that is positioned on the one side D1*a* in the first direction D1. That is, the pressures Pin that are applied to the discharge elements 15 gradually become lower towards the other side D1*b* from the one side D1*a* in the first direction D1.

Similarly to the above, depending upon the locations of the discharge elements 15 that are connected to the second common flow channels 24, the values of the pressures Pout that are applied to the discharge elements 15 differ. More specifically, due to the influence of pressure loss of the liquid flowing through the second common flow channels 24, pressure Pout1 of the discharge element 15*a* that is positioned on the one side D1*a* in the first direction D1 is lower than pressure PoutN of the discharge element 15*n* that is positioned on the other side D1*b* in the first direction D1. That is, the pressures Pout that are applied to the discharge elements 15 gradually become lower towards the one side D1*a* from the other side D1*b* in the first direction D1.

As a result, at the discharge element 15*a* that is disposed closest to the one side D1*a* in the first direction D1, the pressure Pin1 is high and the pressure Pout is low. These correspond to the pressures at the lowermost right side of the graph among the pressures that are applied to the discharge elements 15 in FIG. 9(*b*). At the discharge element 15*n* that is disposed closest to the other side D1*b* in the first direction D1, the pressure Pin is low and the pressure Pout is high. These correspond to the pressures at the uppermost left side of the graph among the pressures that are applied to the discharge elements 15 in FIG. 9(*b*).

The relationship between the pressures Pin1 to N and the pressures Pout1 to N are as described above. Therefore, the pressures that are applied to the discharge elements 15 from the discharge element 15*a* to the discharge element 15*n* are distributed from the lower right side to the upper left side of the graph as shown in FIG. 9(*b*). The distribution is a distribution along the meniscus holding area. Therefore, the distribution of the pressures that are applied to the discharge elements 15 can be within the meniscus holding area.

Due to the above, in the structure of the existing liquid discharge head 102, the pressures that are applied to the discharge elements 15 exist side by side from the upper right side to the lower left side of the graph as shown in FIG. 9(*a*). That is, since the pressures that are applied to the discharge elements 15 exist side by side so as to traverse the meniscus holding area, it is difficult to set the pressures that are applied to the discharge elements 15 within the meniscus holding area. In contrast, in the structure of the liquid discharge head 2 according to the embodiment, the pressures that are applied to the discharge elements 15 are exist side by side from the lower right side to the upper left side of the graph as shown in FIG. 9(*b*). That is, the pressures that are applied to the discharge elements 15 exist side by side along the meniscus holding area, so that it is possible to set the pressures that are applied to the discharge elements 15 within the meniscus holding area.

When the channel resistance R2 of each first discrete flow channel 12 is substantially equal to the channel resistance R3 of each second discrete flow channel 14, in the graph, the meniscus holding area is an area including the pressure Pin=0 and the pressure Pout=0 and inclined by 45 degrees in the lower right direction. The channel resistance R2 of each first discrete flow channel 12 is 0.5 to 2 times the channel resistance R3 of each second discrete flow channel 14, so that the meniscus holding area is an area that is inclined by 30 to 60 degrees in the lower right direction in the graph. Therefore, the meniscus holding area and the distribution of the pressures that are applied to the discharge elements 15 have about the same inclination. This makes it possible to increase the probability with which the distribution of the pressures that are applied to the discharge elements 15 are set within the meniscus holding area.

The first openings 20*a* and the second openings 24*a* are alternately disposed in the second direction D2. Therefore, the first common flow channels 20 and the second common flow channels 24 are alternately disposed in the second direction D2. As a result, it is possible to connect two discharge hole columns 8*a* to one first common flow channel 20, and to connect two discharge hole columns 8*a* to one second common flow channel 24. Therefore, it is possible to dispose the first common flow channels 20 and the second common flow channels 24 with good area efficiency.

The channel resistances R1 to R4 of the flow channels may have the relationship of, for example, R2≈R3>>R1≈R4. In this way, when the channel resistances of the first common flow channels 20 and the second common flow channels 24 are smaller than the channel resistances of the first discrete flow channels 12 and the second discrete flow channels 14, it is possible to reduce the differences between the pressures Pin and the differences between the pressures Pout, occurring due to pressure loss, and to reduce the area of the distribution of the pressures that are applied to the discharge elements 15.

Although the example in which the first direction D1 and the second direction D2 are orthogonal to each other is described, the present invention is not limited thereto. The first direction D1 and the second direction D2 need not be orthogonal to each other. In this case, the first direction D1 and the third direction D3 are the same direction.

Second Embodiment

Figure 10A:
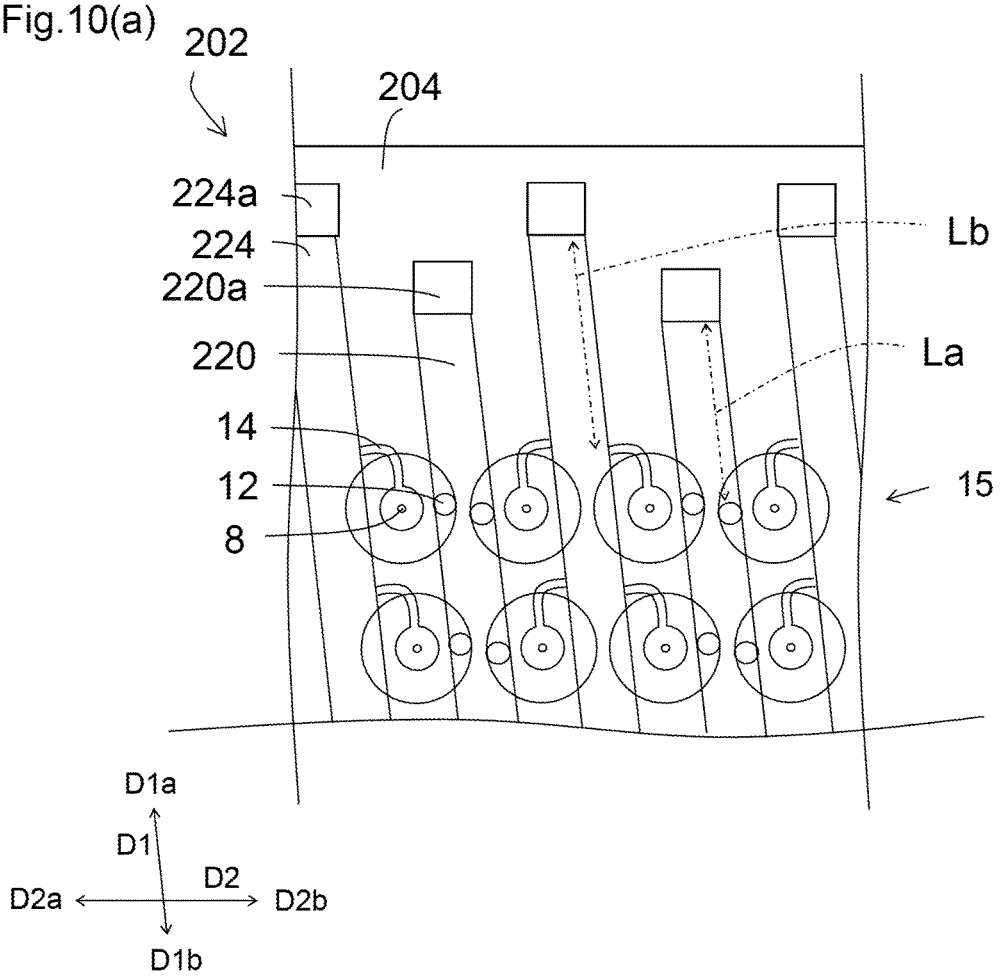
FIGS. 10(*a*) and 10(*b*) are an enlarged plan view and a sectional perspective view, respectively, of a liquid discharge head according to a second embodiment.
Figure 10B:
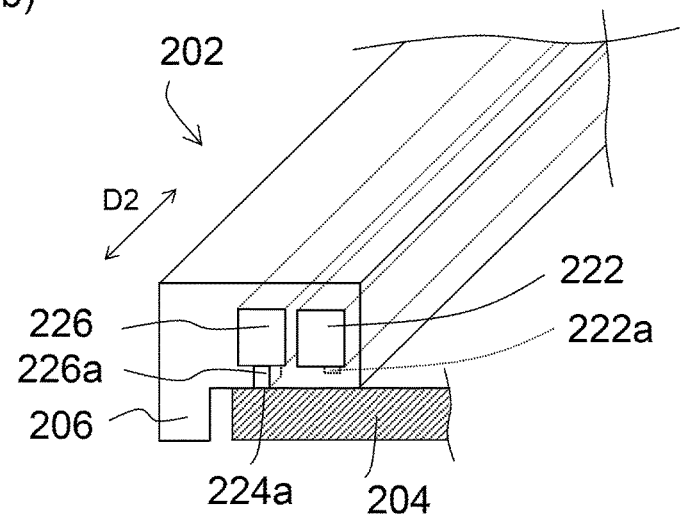

A liquid discharge head 202 is described by using FIG. 10. Corresponding members are given the same reference numerals, and are not described. The liquid discharge head 202 differs from the liquid discharge head 2 in the structure of a first flow channel member 204 and the structure of a second flow channel member 206.

The first flow channel member 204 includes first common flow channels 220, first openings 220*a*, second common flow channels 224, second openings 224*a*, discharge elements 15, first discrete flow channels 12, and second discrete flow channels 14.

The first openings 220*a* and the second openings 224*a* are alternately disposed in the second direction D2. The plurality of first openings 220*a* and the plurality of second openings 224*a* are displaced to each other in the first direction D1.

The second flow channel member 206 includes first integrated flow channels 222 and second integrated flow channels 226 in its interior. The second integrated flow channels 226 are located above the plurality of first openings 220*a*, and are formed so as to be long in the second direction D2. The second integrated flow channels 226 are located above the plurality of second openings 224*a*, and are formed so as to be long in the second direction D2. The first integrated flow channels 222 and the second integrated flow channels 226 are disposed side by side in the second direction D2.

The first integrated flow channels 222 each include a first connecting flow channel 222*a* connected to the corresponding first opening 220*a*. The first connecting flow channels 222*a* extend downward from the first integrated flow channels 222. The second integrated flow channels 226 each include a second connecting flow channel 226*a* connected to the corresponding second opening 224*a*. The second connecting flow channels 226*a* extend downward from the second integrated flow channels 226.

Accordingly, when the first openings 220*a* and the second openings 224*a* are displaced to each other in the first direction D1, it is possible to dispose the first integrated flow channels 222 and the second integrated flow channels 226 side by side. Therefore, when the first connecting flow channels 222*a* and the second connecting flow channels 226*a* extend downward, it is possible to easily connect the first flow channel member 204 and the second flow channel member 206.

When the first integrated flow channels 222 and the second integrated flow channels 226 are adjacent to each other in the first direction D1, heat exchange can be performed between liquid that flows through the first integrated flow channels 222 and liquid that flows through the second integrated flow channels 226, and liquid of uniform temperature can be supplied to each discharge element 15.

As shown in FIG. 10(*a*), in plan view, it is desirable that a distance La between one of the first openings 220*a* and one of the first discrete flow channels 12 disposed closest to the one of the first opening 220*a* (hereunder referred to as the "distance La") be equal to a distance Lb between one of the second openings 224*a* and one of the second discrete flow channels 14 disposed closest to the one of the second openings 224*a* (hereunder referred to as the "distance Lb").

When the distance La and the distance Lb are equal to each other, it is possible to cause the channel resistances of the first common flow channels 220 and the channel resistances of the second common flow channels 224 to be close to each other, and to reduce the range of pressure distribution occurring at the discharge elements 15. The absolute value of the pressure Pin that is applied to each discharge element 15 and the absolute value of the pressure Pout that is applied to each discharge element 15 are the same, and the positive and negative values are easily controlled to opposite values and the pressure that is applied to each discharge element 15 can easily be brought close to 0 (zero).

In the specification, "the distance La and the distance Lb are equal to each other" also includes the case in which the distance La and the distance Lb are substantially equal to each other and the manufacturing error range is ±5%.

Third Embodiment

Figure 11A:
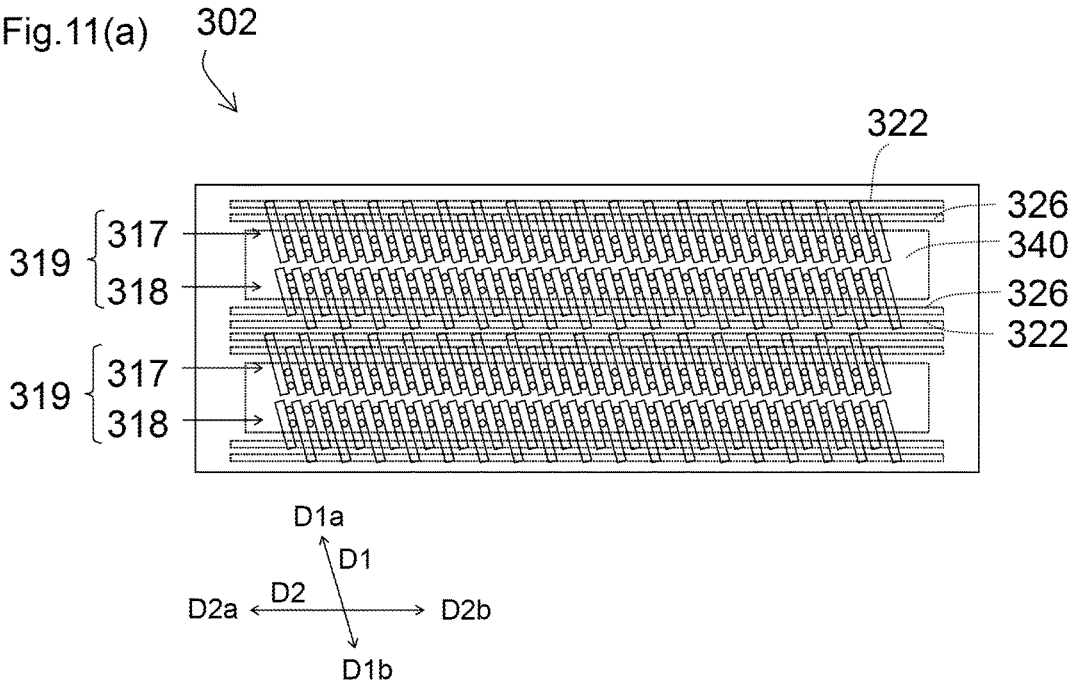
FIGS. 11(*a*) and 11(*b*) are a plan view and a sectional view, respectively, of a liquid discharge head according to a third embodiment.
Figure 11B:
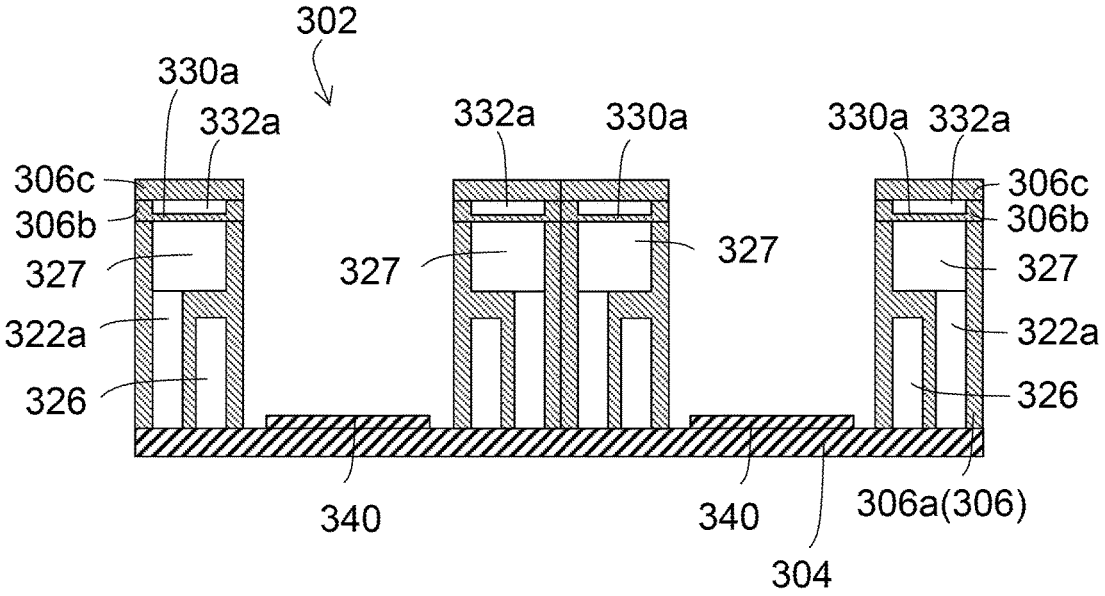
Figure 12:
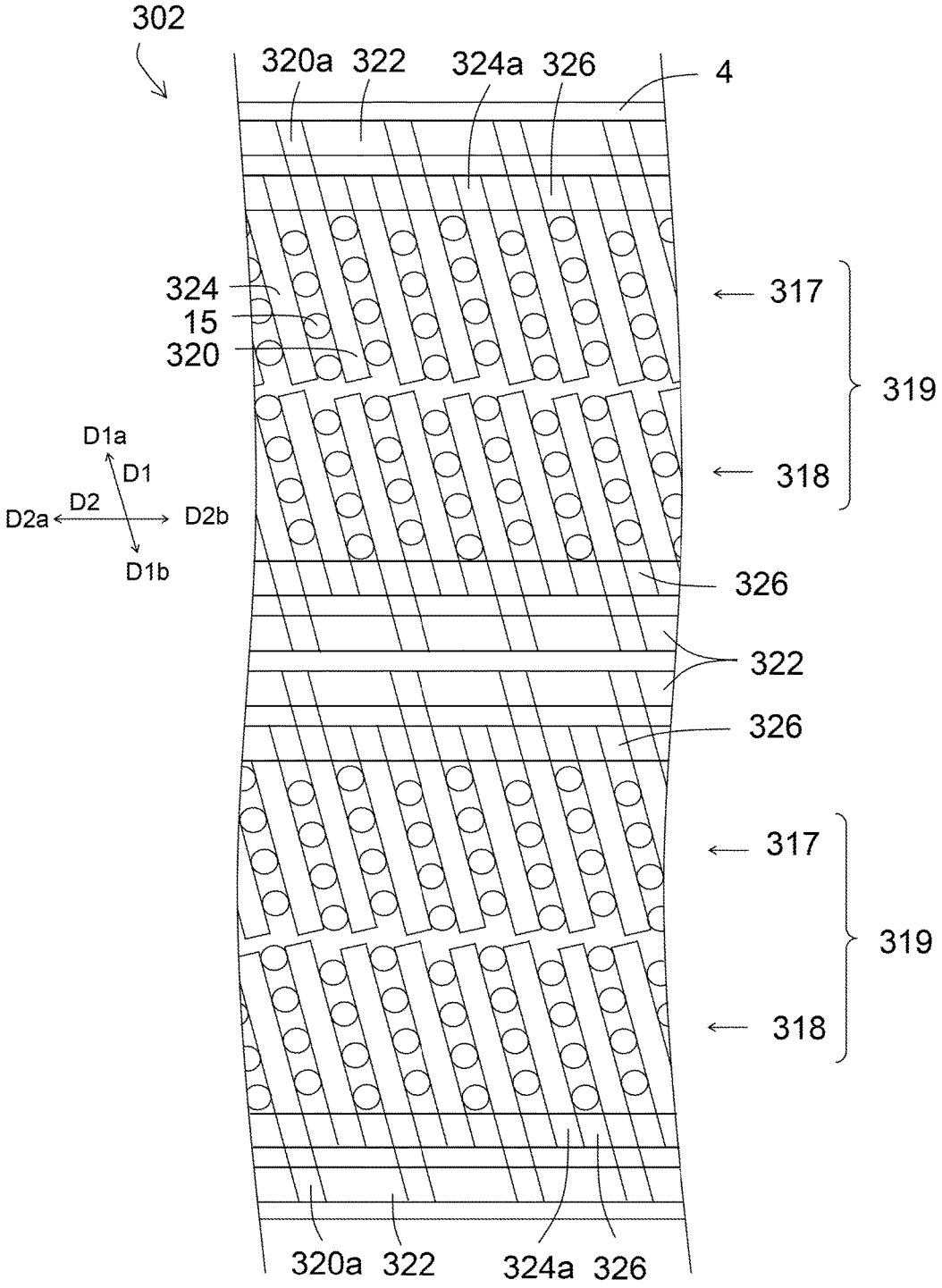
FIG. 12 is an enlarged plan view of part of the liquid discharge head in FIG. 11.

A liquid discharge head 302 is described by using FIGS. 11 and 12. In FIG. 11(*a*), to facilitate understanding, first integrated flow channels 322 and second integrated flow channels 326 of a second flow channel member 306, and a piezoelectric actuator substrate 340 are indicated by broken lines.

The liquid discharge head 302 includes a first flow channel member 304, the second flow channel member 306, and the piezoelectric actuator substrate 340. The second flow channel member 306 and the piezoelectric actuator substrate 340 are disposed on the first flow channel member 304.

The first flow channel member 304 includes various flow channels in its interior, and includes a plurality of discharge units 319. The discharge units 319 are aligned side by side in the first direction D1. The discharge units 319 each include a first discharge section 317 and a second discharge section 318.

Each first discharge section 317 includes first common flow channels 320, first openings 320*a*, second common flow channels 324, second openings 324*a*, discharge elements 15, first discrete flow channels (not shown), and second discrete flow channels (not shown).

Each second discharge section 318 includes first common flow channels 320, first openings 320*a*, second common flow channels 324, second openings 324*a*, discharge elements 15, first discrete flow channels (not shown), and second discrete flow channels (not shown).

The first discharge sections 317 and the second discharge sections 318 are disposed side by side in the first direction D1. The first openings 320*a* in each first discharge section 317 are located on the one side D1*a* in the first direction D1, and the second openings 324*a* in each first discharge section 317 are located on the one side D1*a* in the first direction D1. The first openings 320*a* in each second discharge section 318 are located on the other side D1*b* in the first direction D1, and the second openings 324*a* in each second discharge section 318 are located on the other side D1*b* in the first direction D1.

The second flow channel member 306 includes bodies 306*a*, damper plates 306*b*, and cover plates 306*c*. Each cover plate 306*c* is disposed on the corresponding damper plate 306*b*. Each damper plate 306*b* defines a corresponding first damper chamber 332*a* formed by half etching, and is disposed on the corresponding body 306*a*. By this, first dampers 330*a* are formed.

The second flow channel member 306 includes the plurality of first integrated flow channels 322 and the plurality of second integrated flow channels 326. The first integrated flow channels 322 and the second integrated flow channels 326 are formed so as to be long in the second direction D2. The first integrated flow channels 322 and the second integrated flow channels 326 are disposed side by side. Multiple pairs of the first integrated flow channels 322 and the respective second integrated flow channels 326 are disposed in the first direction D1.

Each first integrated flow channel 322 includes a first liquid chamber 327 whose width is larger than that of the corresponding second integrated flow channel 326. Each first liquid chamber 327 is connected to the corresponding first opening 320*a* via a first connecting flow channel 322*a*. Each second integrated flow channel 326 is disposed below the corresponding first liquid chamber 327. Each first damper chamber 332*a* is located above the corresponding first liquid chamber 327. An upper surface of each first liquid chamber 327 is thinly formed, and each first damper 330*a* opposing the corresponding first liquid chamber 327 is disposed thereat. Therefore, the first liquid chambers 327 and the first dampers 330*a* can reduce pressure variations occurring at the first integrated flow channels 322.

The liquid discharge head 302 includes the first discharge sections 317 and the second discharge sections 318. The first discharge sections 317 and the second discharge sections 318 are disposed side by side in the first direction D1. Therefore, the lengths of the first common flow channels 320 and the second common flow channels 324 of the first discharge sections 317 and the lengths of the first common flow channels 320 and the second common flow channels 324 of the second discharge sections 318 in the first direction D1 can be reduced without reducing the number of discharge elements 15. As a result, it is possible to reduce pressure loss, caused by the first common flow channels 320 and the second common flow channels 324, at the discharge elements 15, and to reduce the range of distribution of pressures that are applied to the discharge elements 15.

The liquid discharge head 302 includes the plurality of discharge units 319. The plurality of discharge units 319 are aligned side by side in the first direction D1. Therefore, the lengths of the first common flow channels 320 and the second common flow channels 324 of the first discharge sections 317 and the lengths of the first common flow channels 320 and the second common flow channels 324 of the second discharge sections 318 in the first direction D1 can be further reduced without reducing the number of discharge elements 15. As a result, it is possible to further reduce the range of distribution of the pressures that are applied to the discharge elements 15.

In the liquid discharge head 302, the first integrated flow channels 322 supply liquid to the first common flow channels 320, and the second integrated flow channels 326 collect the liquid from the second common flow channels 324. This allows the liquid to circulate in the liquid discharge head 302, and to reduce the probability with which, for example, pigments precipitate in the liquid discharge head 302.

In the liquid discharge head 302, each second integrated flow channel 326 is disposed between the corresponding first integrated flow channel 322 and the discharge elements 15. Therefore, it is possible to reduce the distances between the second openings 324*a* and side surfaces of the second common flow channels 324 on the other side D1*b* in the first direction D1. As a result, it is possible to suppress an increase in the channel resistance of each second common flow channel 324.

Each first integrated flow channel 326 includes the corresponding first liquid chamber 327, and the corresponding first damper 330*a* opposing the corresponding first liquid chamber 327 is disposed at the second flow channel member 306. This makes it possible to reduce pressure variations occurring at the first integrated flow channels 322. In particular, since each first damper 330*a* is formed at the first liquid chamber 327 forming the corresponding first integrated flow channel 326 having a high flow rate, it is possible to effectively reduce pressure variations in the liquid discharge head 302.

The first openings 320*a* are disposed towards the one side D1*a* in the first direction D1 than the second openings 324*a* are. Therefore, it is possible to effectively use the space at an upper end portion of the second flow channel member 306, and to dispose the first liquid chambers 327 at the corresponding first integrated flow channels 322.

In plan view, it is desirable that the distance between one of the second openings 324*a* and one of the first discrete flow channels (not shown) disposed closest to the one of the second openings 324*a* be less than the distance between one of the first openings 320*a* and one of the second discrete flow channels (not shown) disposed closest to the one of the first openings 320*a*. This makes it possible to reduce the distance between the second opening 320*a* and a side surface of the second common flow channel 324 on the other side D1*b* in the first direction D1. As a result, it is possible to suppress an increase in the channel resistance of each second common flow channel 324.

"Each second integrated flow channel 326 is disposed between the corresponding first integrated flow channel 322 and the discharge elements 15" means that a side surface of each second integrated flow channel 326 on the one side D1*a* in the first direction D1 is positioned between a side surface of the corresponding first integrated flow channel 322 on the one side D1*a* in the first direction D1 and the discharge elements 15.

The first flow channel member 304 need not include more than one discharge unit 319. That is, the first flow channel member 304 may include one first discharge section 317 and one second discharge section 318. Even in this case, it is possible to reduce pressure loss, caused by the first common flow channels 320 and the second common flow channels 324, at the discharge elements 15, and to reduce the range of distribution of pressures that are applied to the discharge elements 15.

Fourth Embodiment

Figure 13:
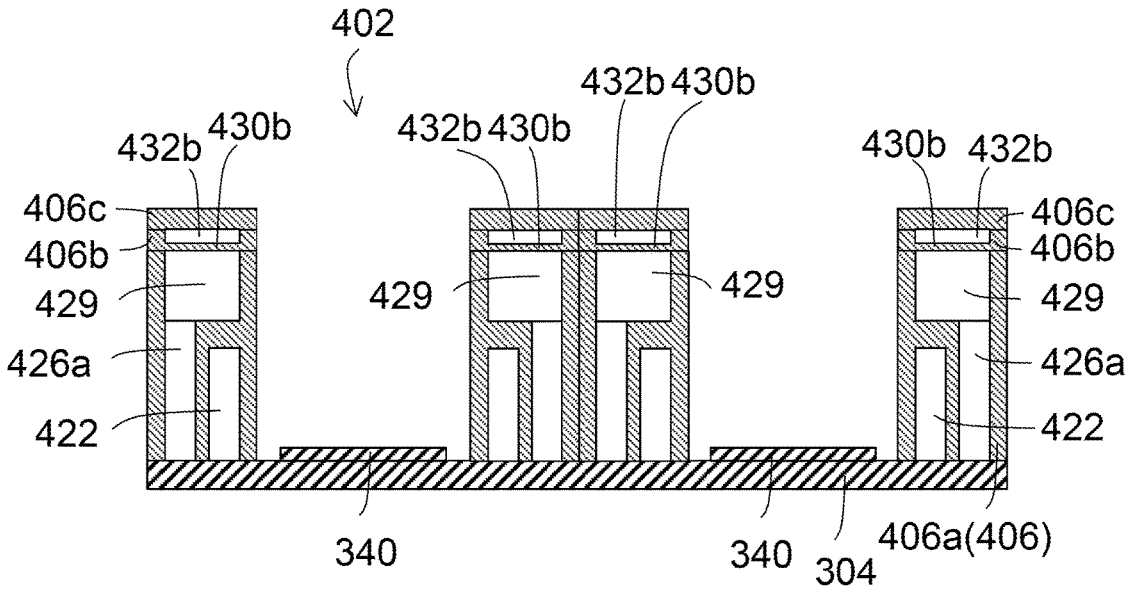
FIG. 13 is a sectional view of a liquid discharge head according to a fourth embodiment.

A liquid discharge head 402 is described by using FIG. 13. The liquid discharge head 402 differs from the liquid discharge head 302 in first integrated flow channels 422 and second integrated flow channels 426.

A second flow channel member 406 includes bodies 406*a*, damper plates 406*b*, and cover plates 406*c*. The cover plates 406*c* are disposed on the damper plates 406*b*. The damper plates 406*b* are disposed on the bodies 406*a*. By this, second damper chambers 432*a* and second dampers 430*b* are formed.

The second flow channel member 406 includes the plurality of first integrated flow channels 422 and the plurality of second integrated flow channels 426. Each second integrated flow channel 426 includes a second liquid chamber 429 whose width is larger than that of the corresponding first integrated flow channel 422. Each second liquid chamber 429 is connected to the corresponding second opening 424*a* via a second connecting flow channel 426*a*.

Each first integrated flow channel 422 is disposed below the corresponding second liquid chamber 429. An upper surface of each second liquid chamber 429 is thinly formed, and each second damper 430*b* opposing the corresponding second liquid chamber 429 is disposed thereat. Therefore, the second liquid chambers 429 and the second dampers 430*b* can reduce pressure variations occurring at the second integrated flow channels 426.

In the liquid discharge head 402, the first integrated flow channels 422 are disposed between the second integrated flow channels 426 and discharge elements 15. Therefore, it is possible to reduce the distances between the first openings 420*a* and side surfaces of the first common flow channels 420 on the other side D1*b* in the first direction D1. As a result, it is possible to suppress an increase in the channel resistance of each first common flow channel 420.

Each second integrated flow channel 426 includes the corresponding second liquid chamber 429, and each second damper 430*b* opposing the corresponding second liquid chamber 429 is disposed at the second flow channel member 406. This makes it possible to reduce pressure variations occurring at the second integrated flow channels 426.

Although the first to fourth embodiments are described above, the present invention is not limited to the above-described embodiments. Various modifications may be made without departing from the gist of the present invention. For example, although the printer 1 using the liquid discharge heads 2 according to the first embodiment is described, the present invention is not limited thereto. Liquid discharge heads 2 according to other embodiments may be used in the printer 1. Alternatively, a plurality of embodiments may be combined as appropriate.

Although the compressing portions that compress the compression chambers 10 by piezoelectric deformation of the piezoelectric actuator are described as examples, the present invention is not limited thereto. For example, the compressing portions may be ones that that compress liquid by thermal expansion by heating liquid in the compression chambers 10 by using heat from heating sections, each allocated for each one of the compression chambers 10.

Although the example in which liquid is supplied to the first integrated flow channels 22 from the outside and liquid is collected at the outside from the second integrated flow channels 26 is described, the present invention is not limited thereto. Liquid may be supplied to the second integrated flow channels 26 from the outside and liquid may be collected at the outside from the first integrated flow channels 22. Further, although the example in which each liquid discharge head 2 has a circulation structure is described, each liquid discharge head 2 need not have a circulation structure.

REFERENCE SIGNS LIST color inkjet printer
liquid discharge head
2*a* head body
first flow channel member
second flow channel member
8 discharge hole
10 compression chamber
12 first discrete flow channel
14 second discrete flow channel
15 discharge element
17 first discharge section
18 second discharge section
19 discharge unit
20 first common flow channel
20*a* first opening
22 first integrated flow channel
24 second common flow channel
24*a* second opening
26 second integrated flow channel
40 piezoelectric actuator substrate
40*a*, 40*b* piezoelectric ceramic layer
48 displacement element (compressing portion)
50 housing
76 control section
P print sheet
D1 first direction
D1*a* one side in first direction
D1*b* another side in first direction
D2 second direction
D2*a* one side in second direction
D2*b* another side in second direction
D3 third direction
D3*a* one side in third direction
D3*b* another side in third direction

The invention claimed is:

1. A liquid discharge head comprising:

a flow channel member; and a compressing portion located on the flow channel member, wherein the flow channel member comprises:

a plurality of discharge elements, which the compressing portion is configured to compress each of the plurality of discharge elements to discharge liquid;

a plurality of first discrete flow channels, each allocated for a respective one of the plurality of discharge elements;

a plurality of second discrete flow channels, each allocated for a respective one of the plurality of discharge elements;

a plurality of first common flow channels, each including a first opening, which extend from one side to another side in a first direction, are connected commonly to the plurality of first discrete flow channels and connect a first common flow channel of the plurality of first common flow channels to an outside, wherein the first opening is located on the one side of the first common flow channel in the first direction;

a plurality of second common flow channels, each including a second opening, which extend from the one side to the other side in the first threction, are connected commonly to the plurality of second discrete flow channels, and connect a second common flow channel of the plurality of second common flow channels to the outside, wherein the second opening is located on the one side of the second common flow channel in the first direction, wherein each first opening and each second opening are alternately disposed in a second direction crossing the first direction.

2. The liquid discharge head according to claim 1, wherein a channel resistance of each of the first discrete flow channels is 0.5 to 2 times a channel resistance of each of the second discrete flow channels.

3. The liquid discharge head according to claim 1, wherein the first openings and the second openings are displaced to each other in the first direction.

4. The liquid discharge head according to claim 3, wherein the first openings are disposed towards the one side in the first direction than the second openings are.

5. The liquid discharge head according to claim 1, wherein, in plain view, a distance between the first opening or one of the first openings and one of the first discrete flow channels disposed closest to the first opening or the one of the first openings is equal to a distance between the second opening or one of the second openings and one of the second discrete flow channels disposed closest to the second opening or the one of the second openings.

6. The liquid discharge head according to claim 1, further comprising:

a reservoir on the flow channel member, wherein the reservoir includes a third common flow channel that supplies liquid to the first common flow channel, and a fourth common flow channel configured to collect liquid from the second common flow channel.

7. The liquid discharge head according to claim 6, wherein, in plain view, the fourth common flow channel is disposed between the third common flow channel and the discharge elements.

8. The liquid discharge head according to claim 6, wherein the third common flow channel includes a first liquid chamber whose width is larger than a width of the fourth common flow channel, and wherein a first damper opposing the first liquid chamber is formed.

9. The liquid discharge head according to claim 6, wherein, in plan plain view, the third common flow channel is disposed between the fourth common flow channel and the discharge elements.

10. The liquid discharge head according to claim 9, wherein the fourth common flow channel includes a second liquid chamber whose width is larger than a width of the third common flow channel, and wherein a second damper opposing the second liquid chamber is formed.

11. The liquid discharge head according to claim 1, further comprising:

a transporting section that transports a recording medium with respect to the liquid discharge head; and a control section that controls the liquid discharge head.

12. A liquid discharge head comprising:

a flow channel member; and a compressing portion located on the flow channel member, wherein the flow channel member comprises:

a plurality of discharge elements, which the compressing portion is configured to compress each of the plurality of discharge elements to discharge liquid;

a plurality of first discrete flow channels, each allocated for a respective one of the plurality of discharge elements;

a plurality of second discrete flow channels, each allocated for a respective one of the plurality of discharge elements;

a first common flow channel extending from one side to another side in a first direction and connected commonly to the plurality of first discrete flow channels;

a first opening that connects the first common flow channel and an outside;

a second common flow channel extending from the one side to the other side in the first direction and connected commonly to the plurality of second discrete flow channels; and a second opening that connects the second common flow channel and the outside, wherein the first opening is located on the one side of the first common flow channel in the first direction, wherein the second opening is located on the one side of the second common flow channel in the first direction, and wherein, in plain view, a distance between the second opening or one of the second openings and one of the first discrete flow channels disposed closest to the second opening or the one of the second openings is less than a distance between the first opening or one of the first openings and one of the second discrete flow channels disposed closest to the first opening or the one of the first openings.

13. The liquid discharge head according to claim 12, further comprising;

a transporting section that transports a recording medium with respect to the liquid discharge head; and a control section that controls the liquid discharge head.

14. A liquid discharge head comprising:

a flow channel member; and a compressing portion located on the flow channel member, wherein the flow channel member comprises:

a plurality of discharge elements, which the compressing portion is configured to compress each of the plurality of discharge elements to discharge liquid;

a plurality of first discrete flow channels, each allocated for a respective one of the plurality of discharge elements;

a plurality of second discrete flow channels, each allocated for a respective one of the plurality of discharge elements;

a first common flow channel extending from one side to another side in a first direction and connected commonly to the plurality of first discrete flow channels;

a first opening that connects the first common flow channel and an outside;

a second common flow channel extending from the one side to the other side in the first direction and connected commonly to the plurality of second discrete flow channels; and a second opening that connects the second common flow channel and the outside, wherein the first opening is located on the one side of the first common flow channel in the first direction, wherein the second opening is located on the one side of the second common flow channel in the first direction, wherein a first discharge section includes:

the plurality of discharge elements, the plurality of first discrete flow channels, the plurality of second discrete flow channels, the first common flow channel or the first common flow channels, the first opening or the first openings, the second common flow channel or the second common flow channels, and the second opening or the second openings; and a second discharge section includes:

the plurality of discharge elements, the plurality of first discrete flow channels, the plurality of second discrete flow channels, the first common flow channel or the first common flow channels, the first opening or the first openings, the second common flow channel or the second common flow channels, and the second opening or the second openings, wherein the first discharge section and the second discharge section are disposed side by side in the first direction, wherein the first opening in the first discharge section is located on the one side in the first direction, and the second opening in the first discharge section is located on the one side in the first direction, and wherein the first opening in the second discharge section is located on the other side in the first direction, and the second opening in the second discharge section is located on the other side in the first direction.

15. The liquid discharge head according to claim 14, further comprising a plurality of discharge units, each including the first discharge section and second discharge section, wherein the plurality of discharge units is aligned in the first direction.

16. The liquid discharge head according to claim 14, further comprising;

a transporting section that transports a recording medium with respect to the liquid discharge head; and a control section that controls the liquid discharge head.

* * * * *